US007522851B2

(12) United States Patent
Koyama et al.

(10) Patent No.: US 7,522,851 B2
(45) Date of Patent: Apr. 21, 2009

(54) DEVELOPING DEVICE

(75) Inventors: Tetsu Koyama, Tokyo (JP); Shinichi Otani, Tokyo (JP)

(73) Assignee: Oki Data Corporation, Tokyo (JP)

( * ) Notice: Subject to any disclaimer, the term of this patent is extended or adjusted under 35 U.S.C. 154(b) by 181 days.

(21) Appl. No.: 11/068,907

(22) Filed: Mar. 2, 2005

(65) Prior Publication Data

US 2005/0196184 A1 Sep. 8, 2005

(30) Foreign Application Priority Data

Mar. 8, 2004 (JP) ..... 2004-064270

(51) Int. Cl.
*G03G 15/08* (2006.01)

(52) U.S. Cl. ..... 399/27; 399/258; 399/260

(58) Field of Classification Search ..... 399/258, 399/260, 262, 263, 27
See application file for complete search history.

(56) References Cited

U.S. PATENT DOCUMENTS

| | | | | |
|---|---|---|---|---|
| 5,296,900 | A * | 3/1994 | Saijo et al. | 399/260 |
| 5,652,947 | A * | 7/1997 | Izumizaki | 399/58 |
| 6,983,116 | B2 * | 1/2006 | Maetani | 399/252 |
| 7,187,876 | B2 | 3/2007 | Ito et al. | |
| 2002/0034404 | A1 * | 3/2002 | Kojima et al. | 399/258 |

FOREIGN PATENT DOCUMENTS

JP 2002-072657 3/2002

* cited by examiner

*Primary Examiner*—Hoang Ngo
(74) *Attorney, Agent, or Firm*—Rabin & Berdo, P.C.

(57) ABSTRACT

A toner container (101) is detachably attached to a developing device (104). A toner (120) stored in the toner container (101) is supplied through a supply opening (104*a*) to a hopper (105) of the developing device (104). A movable shutter (123) is provided below the supply opening (104*a*). The shutter (123) opens the supply opening (104*a*) when the amount of the toner (121) in the hopper (105) is less than a predetermined amount, and closes the supply opening (104*a*) when the amount of the toner (121) in the hopper (105) is greater than or equals to the predetermined amount.

16 Claims, 19 Drawing Sheets

DEVELOPING DEVICE

BACKGROUND OF THE INVENTION

This invention relates to a developing device that develops a latent image with a developer (for example, a toner) in an image forming apparatus such as an electrophotographic recording device.

In a general electrophotographic recording device, a photosensitive body (i.e., a latent image bearing body) is uniformly charged, and is exposed to the light so that a latent image is formed thereon. The latent image on the photosensitive body is developed (visualized) with a toner that adheres to the latent image. The developed toner image is transferred to a recording medium, and is fixed to the recording medium. Components for causing the toner to adhere to the photosensitive body are integrally constructed as a developing device. The developing device is detachably attached to a main body of the electrophotographic recording device.

A toner container (i.e., a toner cartridge) storing the toner is detachably attached to the developing device, and the toner is supplied from the toner container to the developing device. When the toner container is attached to the developing device, a shutter of the toner container is opened so that the toner (stored in the toner container) falls in the interior of a hopper of the developing device. Such a developing device is disclosed in, for example, Japanese Laid-open Patent Publication No. 2002-72657.

In the conventional developing device, the shutter is kept opened when the toner container is attached to the developing device, and therefore the toner container keeps supplying the toner to the developing device. Accordingly, if the amount of toner consumption is small, the density of the toner in the hopper may increase, and the pressure in the hopper may also increase. The pressure increase in the hopper may cause a failure in forming a thin toner layer (on the photosensitive body) or a failure in charging the toner in the developing device. In such a case, a printing quality may be degraded.

SUMMARY OF THE INVENTION

An object of the present invention is to provide a developing device capable of preventing the pressure increase of the toner in the developing device to thereby enhance the printing quality.

The invention provides a developing device to which a developer container is detachably attached. The developing device includes a storing portion in which a developer is stored, a supply opening through which the toner is supplied from the developer container to said storing portion, and an adjusting mechanism for adjusting the supply of the developer to said storing portion through the supply opening.

The supply of the developer to the main body is adjusted by the adjusting mechanism, and therefore it becomes possible to keep the amount of the developer in the developing device within a suitable range. Thus, it becomes possible to prevent the pressure increase of the toner in the developing device, with the result that the printing quality can be enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Figure 1:
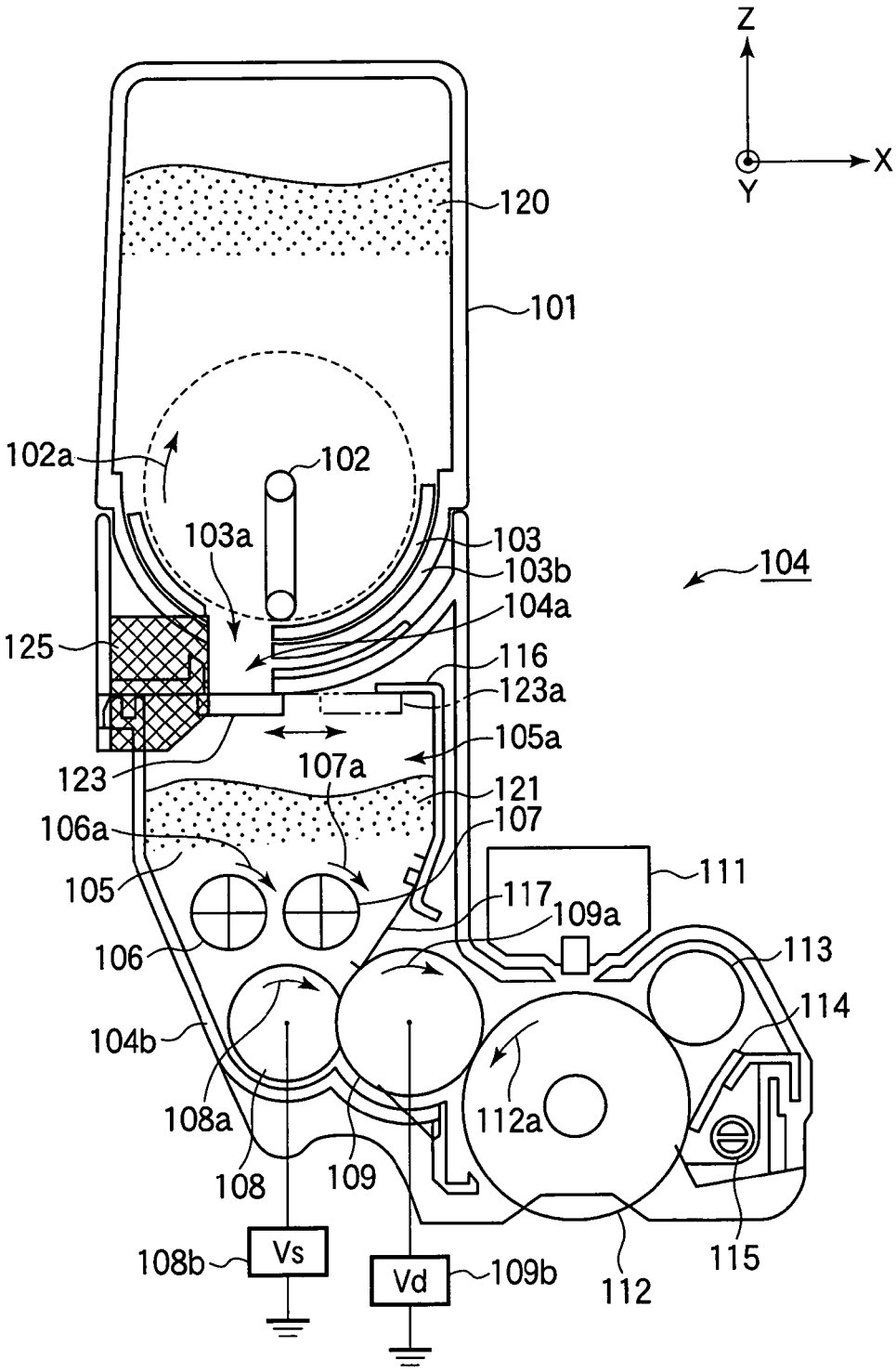
FIG. 1 is a sectional side view of a developing device according to the first embodiment.

Embodiments of the present invention will be described with reference to the attached drawings. In the attached drawings, the same components illustrated in a plurality of drawings are assigned the same reference numerals.

First Embodiment

FIG. 1 is a sectional side view of a developing device according to the first embodiment of the present invention. In FIG. 1, a toner container 101 is detachably attached to the top of a developing device 104. The developing device 104 is elongated in one direction. In FIG. 1, Y-axis is defined as a longitudinal direction of the developing device 104. Z-axis is defined as a vertical axis. X-axis is defined as being perpendicular to Y-axis and Z-axis.

The toner container 101 stores a toner (i.e., a developer) 120, and has a rotatable toner agitating bar 102. The toner agitating bar 102 is driven by a not shown driving source and rotates in the direction shown by an arrow 102*a*. A toner container 101 has a semicylindrical bottom wall 103*b* having a supply opening 103*a* through which the toner is supplied to the developing device 104. A semicylindrical toner shield wall 103 is provided on the inner side of the bottom wall 103*b*, and rotatable for opening and closing the supply opening 103*a*. The toner shield wall 103 closes the supply opening 103*a* when the toner container 101 is not attached to the developing device 104, and opens the supply opening 103*a* when the toner container 101 is attached to the developing device 104.

The developing device 104 has an outer wall 104*b* in which a hopper (i.e., a storing portion) 105 is formed. A supply opening 104*a* is formed on the top of the outer wall 104*b*. The supply opening 104*a* is located on a position that faces the supply opening 103*a* of the toner container 101. The developing device 104 has a movable shutter 123 provided below the supply opening 104*a*. The structure and the operation of the shutter 123 will be described later. Toner agitating screws 106 and 107 are provided in the hopper 105. The toner agitating screws 106 and 107 are rotated by a not-shown driving source in the directions shown by arrows 106*a* and 107*a*, and circulate the toner 121 in the hopper 105 in the direction of Y-axis, to thereby agitate the toner 121 in the hopper 105.

A supply roller 108 is provided in the hopper 105, and is provided below the toner agitating screws 106 and 107. A developing roller 109 is urged against the supply roller 108. An electric potential Vs (V) is applied to the supply roller 108 by a power source 108*b*. The supply roller 108 is rotated in the direction shown by an arrow 108*a* by a driving force transmitted from a not-shown driving source, so as to supply the toner to the developing roller 109. An electric potential Vd (V) is applied to the developing roller 109 by a power source 109*b*. The developing roller 109 is rotated in the direction shown by an arrow 109*a* by a driving force transmitted from a not-shown driving source. The magnitude of the electric potentials Vs and Vd satisfy $|VS|>|Vd|$ so that the toner moves from the supply roller 108 to the developing roller 109.

A developing blade 117 is urged against the developing roller 109, and regulates the thickness of the toner layer formed on the surface of the developing roller 109. The developing blade 117 is fixed to the outer wall 104*b* via a fixing member 116. The developing roller 109 contacts a photosensitive drum (an image bearing member) 112. The photosensitive drum 112 rotates in the direction shown by an arrow 112*a*. Along the circumference of the photosensitive drum 112, a printing head 111, a charging roller 113 and a cleaning blade 114 are provided. As the photosensitive drum 112 rotates, electrophotographic processes (described later) are performed.

Figure 2:
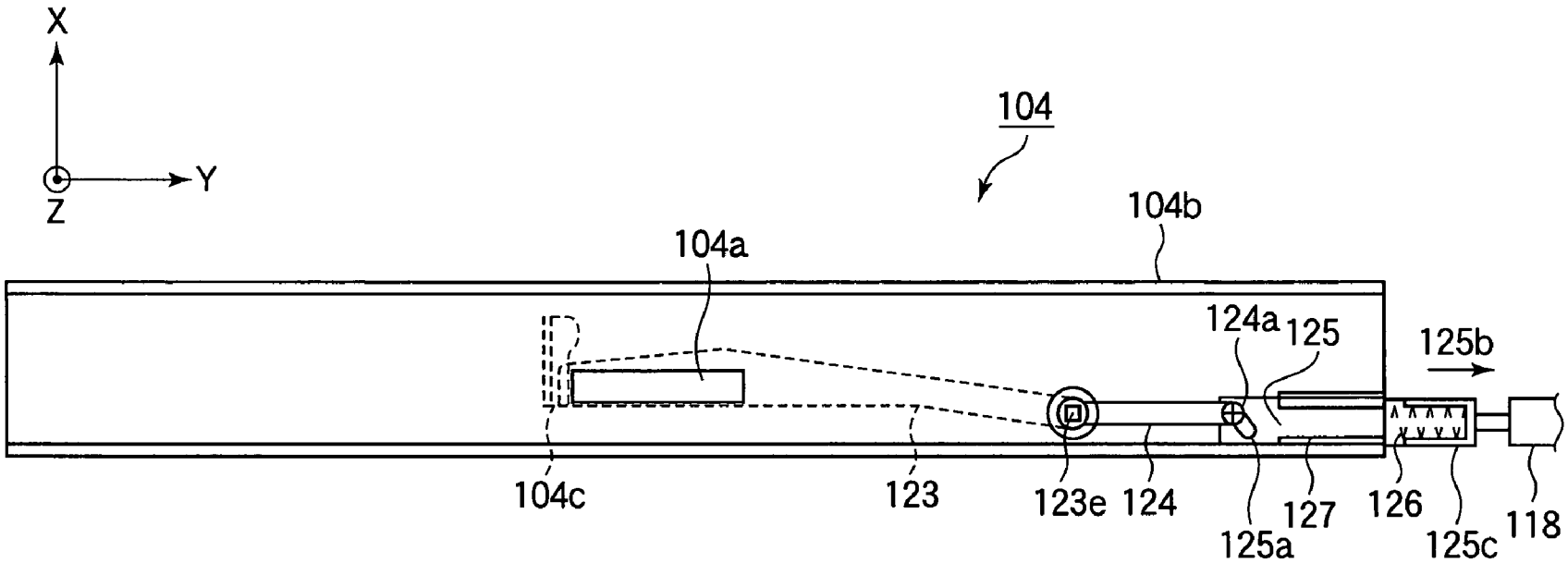
FIG. 2 is a top view of a main part of the developing device according to the first embodiment.

FIG. 2 is a top view of the main part of the developing device 104 according to the first embodiment, in a state where the toner container 101 is not attached to the developing device 104. The supply opening 104*a* is located substantially on the center position of the developing device 104 seen from above. The shutter 123 is provided below the supply opening 104*a* to open and close the supply opening 104*a*. One end (i.e., a first end) of the shutter 123 is slidably guided by a guide member 104*c* in the direction of X-axis, and the other end (i.e., a second end) of the shutter 123 is connected to a lever 124. A projection 123*e* is formed on the second end of the shutter 123, and projects outside the developing device 104 in the direction of Z-axis (i.e., perpendicular to the sheet of FIG. 2). The projection 123*e* functions as a fulcrum of the shutter 123 and the lever 124. The shutter 123 and the lever 124 rotate about the projection 123*e* together with each other with no phase difference.

The lever 124 has a projection 124*a* formed on an opposite end to the projection 123*e*. The projection 124*a* is inserted in a groove 125*a* formed on a slide member 125 so that the projection 124*a* is slidable in the groove 125*a*. The groove 125*a* is inclined with respect to the direction of Y-axis. The slide member 125 is slidably supported by a guide member 127 in the direction of Y-axis, and urged by a spring 126 in the direction indicated by an arrow 125*b*. An end 125*c* of the slide member 125 projects outside the developing device 104 in the direction of Y-axis, and is fixed to a plunger of a solenoid (i.e., a linear actuator) 118.

Figure 3:
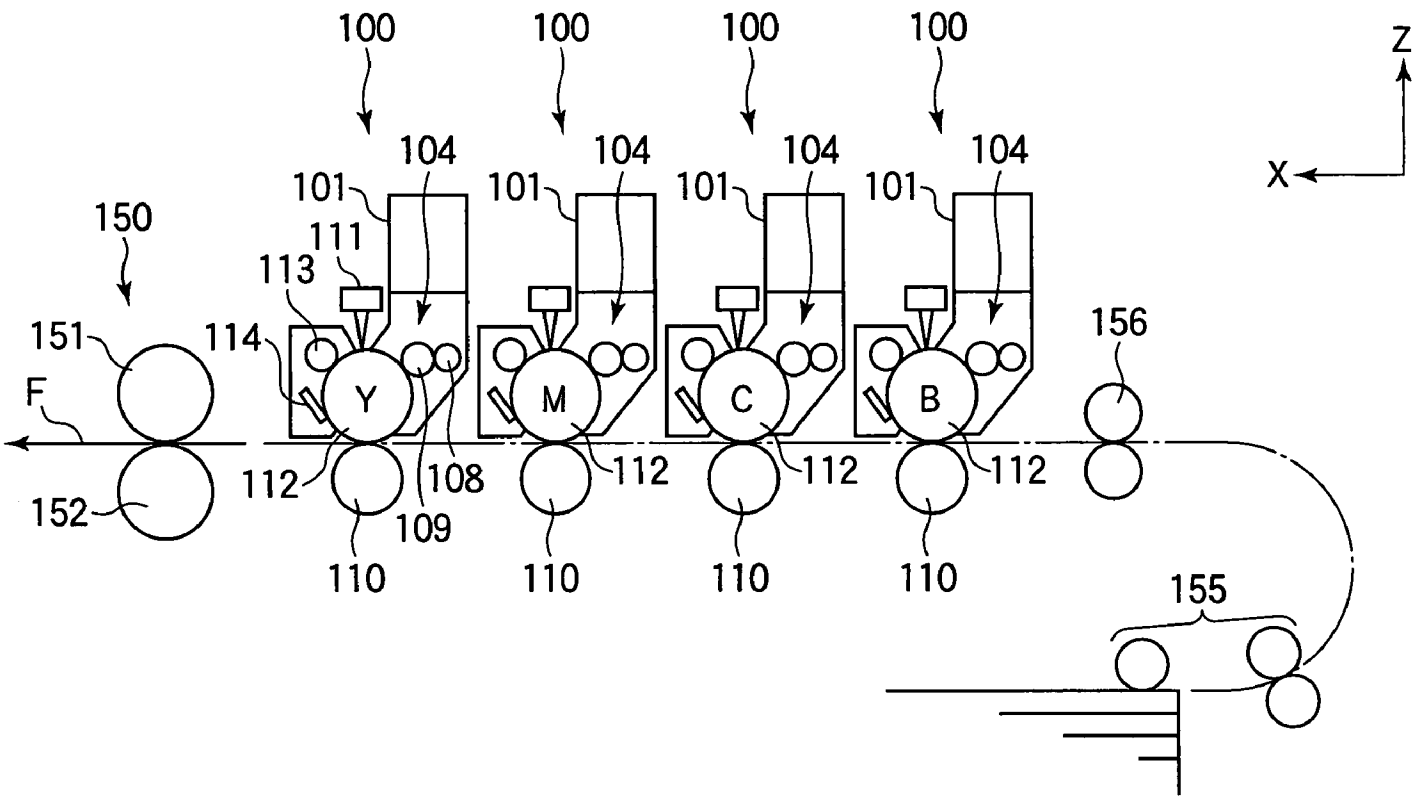
FIG. 3 is a schematic view of an example of an image forming apparatus using the developing device of the first embodiment.

FIG. 3 is a schematic side view of an image forming apparatus employing the developing device 104, seen in an opposite direction with respect to FIG. 1. The developing device 104, the photosensitive drum 112, the charging roller 113, the printing head (i.e., an exposing device) 111 and the cleaning blade 114 constitute an image forming unit 100. Four image forming units 100 of yellow (Y), magenta (M), cyan (C) and black (B) are arranged along a feeding path F of a recording medium such as a paper. Four transfer rollers 110 are provided in opposition to the photosensitive drums 112 of the respective image forming units 100 via the feeding path F. A fixing device 150 is provided on the downstream side of the image forming units 100. The fixing device 150 includes a heat roller 151 and a pressure roller 152 that heat and press the recording medium therebetween for fixing the toner image to the recording medium.

Next, the printing operation of the image forming apparatus will be described. The recording medium is supplied by a medium supply device 155, and is fed to feeding rollers 156 provided on the upstream side of the image forming units 100. The feeding rollers 156 correct the skewing of the recording medium, and feed the recording medium to the image forming units 100 along the feeding path F. While the recording medium is fed along the feeding path F through the image forming units 100 of yellow, magenta, cyan and black, toner images of four colors are respectively transferred to the recording medium. In each of the image forming units 100, the photosensitive drum 112 rotates in the direction indicated by the arrow 112*a* (FIG. 1), and electrophotographic processes are performed. In particular, the charging roller 113 uniformly charges the surface of the photosensitive drum 112, and the printing head 111 exposes the surface of the photosensitive drum 112 to form the latent image thereon. The toner (which forms a thin toner layer on the developing roller 109) adheres to the latent image on the photosensitive drum 112, so that the toner image is formed on the photosensitive drum 112. The toner image is transferred to the recording medium by the transfer roller 110, and the residual toner remaining on the surface of the photosensitive drum 112 is scraped by the cleaning blade 114. After toner images of four colors are transferred to the recording medium, the recording medium is fed to the fixing device 150. In the fixing device 150, the recording medium is heated and pressed by the heat roller 151 and the pressure roller 152, so that the toner image is fixed to the recording medium. After the toner image is fixed to the recording medium, the recording medium is ejected out of the image forming apparatus, with the result that the printing operation is completed.

In the developing device 104, as shown in FIG. 1, the toner agitating screws 106 and 107 respectively rotate in the directions 106*a* and 107*a* to circulate the toner 121 in the hopper 105 in the direction of Y-axis to thereby agitate the toner 121. The supply roller 108 is given the electric potential Vs (V) by the power source 108*b*, and rotates in the direction indicated by the arrow 108*a*, so as to supply toner to the developing roller 109. The developing roller 109 is given the electric potential Vd (V) by the power source 109*b*, and rotates in the direction indicated by the arrow 109*a*. A thin toner layer is formed on the surface of the developing roller 109. The toner layer has a uniform thickness regulated by the developing blade 117, and the toner is charged by the developing blade 117. The charged toner on the developing roller 109 adheres to the latent image formed on the photosensitive drum 112. In this process, the formation of the thin toner layer and the charging of the toner are suitably performed, because an excessive pressure is not applied to the toner 121 in the hopper 105.

Figure 4:
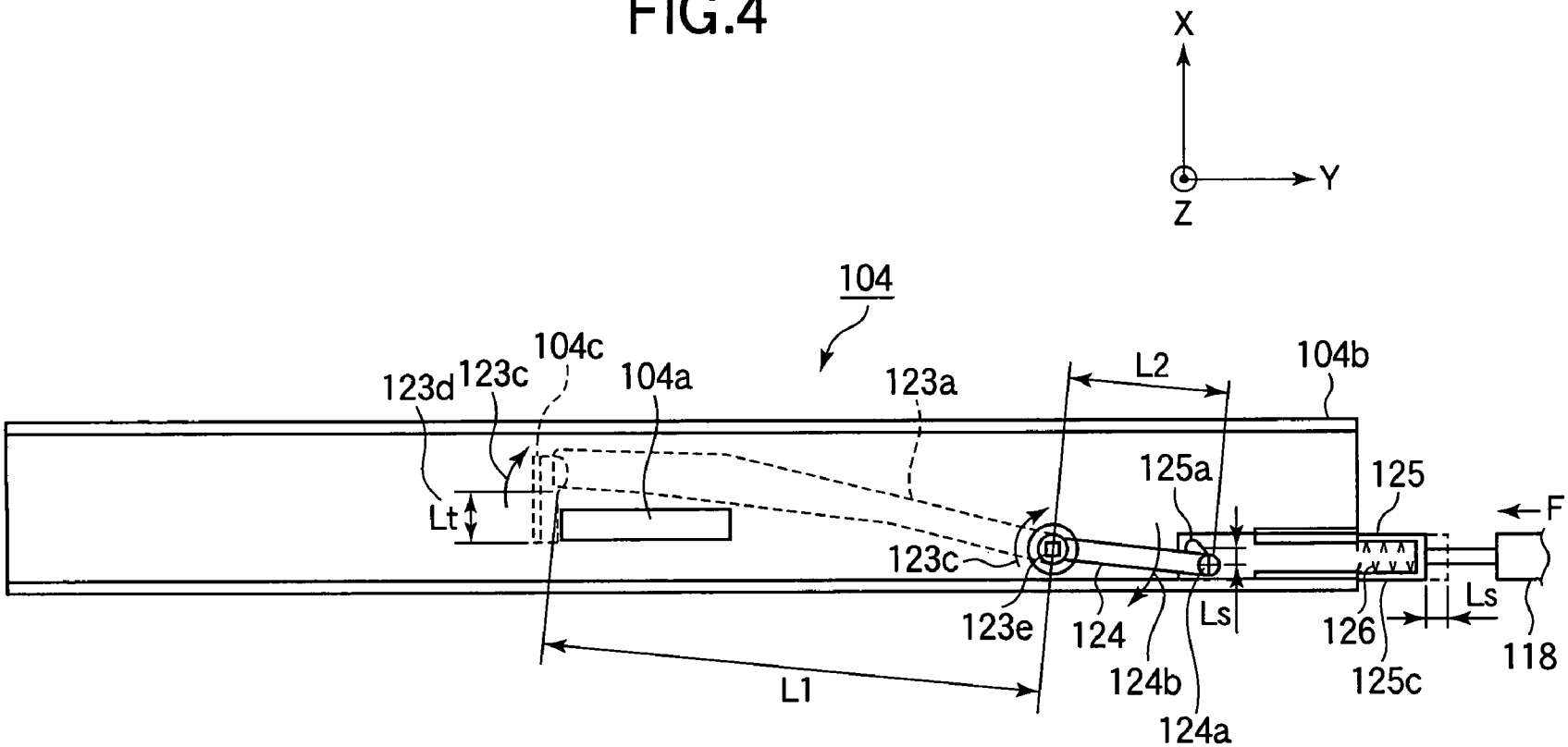
FIG. 4 is a top view showing an operation of the developing device according to the first embodiment.

Next, the operation of the developing device 104 of the first embodiment will be described in detail. FIG. 4 is a top view showing an operation of the developing device 104 of the first embodiment. The toner container 101 is attached to the developing device 104, and the supply opening 103*a* is opened as shown in FIG. 1. A toner amount detection sensor 190 (FIG. 19) as a detection unit is provided for detecting the amount of the toner 121 in the hopper 105. The toner amount detection sensor 190 will be described later with reference to FIG. 19. The amount of the toner 121 in the hopper 105 can also be detected by a detecting method disclosed in Japanese Laid-Open Patent Publication No. 2002-72657.

Based on the toner amount detection sensor 190 (FIG. 19), when the amount of the toner 121 in the hopper 105 is less than a predetermined amount, a controller (not shown) of the developing device 104 drives the solenoid 118 to apply the force F to the end 125*c* of the slide member 125 in the direction toward the inside of the developing device 104. Because of the force F, the slide member 125 moves a distance Ls in the same direction, so that the projection 124*a* of the lever 124 rotates along the groove 125*a* in the direction indicated by an arrow 124*b*. Because of this rotation, the end of the lever 124 (i.e., the projection 124*a*) shifts a distance Ls in the direction of X-axis.

By the rotation of the lever 124, the shutter 123 rotates clockwise (i.e., in the direction indicated by an arrow 123*c*) about the projection 123*e*, so that the end of the shutter 123 moves a distance Lt in the direction of X-axis. Because of this movement, the shutter 123 moves away from a position below the supply opening 104*a* to a position 123*a* shown in FIG. 4. As a result, the toner in the toner container 101 is allowed to fall in the interior of the hopper 105.

In a state where the supply opening 104*a* of the developing device 104 is opened, the agitating bar 102 (FIG. 1) rotates in the direction indicated by the arrow 102*a*, and supplies the toner 120 from the toner container 101 to the hopper 105 through the supply opening 104*a*. The supplied toner 121 is stored in the hopper 105.

Based on the toner amount detection sensor 190 (FIG. 19), when the amount of the toner 121 in the hopper 105 is greater than or equals to the predetermined amount, the controller stops driving the solenoid 118, so that the slide member 125 moves in the direction indicated by the arrow 125*b* (FIG. 2) by the force of the spring 126. Thus, the lever 124 and the shutter 123 return to their original positions as shown in FIG. 2. The shutter 123 closes the supply opening 104*a*, so that the supply of the toner is stopped. With such an operation, the amount of the toner 121 in the hopper 105 is kept within a suitable range.

As described above, according to the first embodiment, when the amount of the toner 121 in the hopper 105 is less than the predetermined amount, the shutter 123 opens the supply opening 104*a* to supply the toner to the hopper 105. When the amount of the toner 121 in the hopper 105 is greater than or equals to the predetermined amount, the shutter 123 closes the supply opening 104*a* to stop the supply of the toner. Thus, it is ensured that a sufficient space 105*a* is formed in the hopper 105 as shown in FIG. 1, and therefore the increase of the density of the toner 121 in the hopper 105 is prevented. Accordingly, the pressure increase of the toner 121 in the hopper 105 is prevented. As a result, the formation of the thin toner layer on the developing roller 109 and the charging of the toner by the developing blade 117 are suitably performed, with the result that the printing quality is enhanced.

Moreover, as shown in FIG. 4, the moving amount Lt of the shutter 123 in the direction of X-axis is expressed as L1=(L1/L2)×Ls, where L1 is the length of the shutter 123 and L2 is the length of the lever 124. By setting the length L1 longer than the length L2 (i.e., L1>L2), the moving amount Ls of the lever 124 can be shorter than the moving amount Lt (i.e., Lt>Ls) of the shutter 123. As the moving amount of the lever 124 can be shorter, the moving amounts of driving parts for opening and closing the shutter 123 can be reduced. Thus, the developing device 104 meets the miniaturization needs.

Second Embodiment

Figure 5:
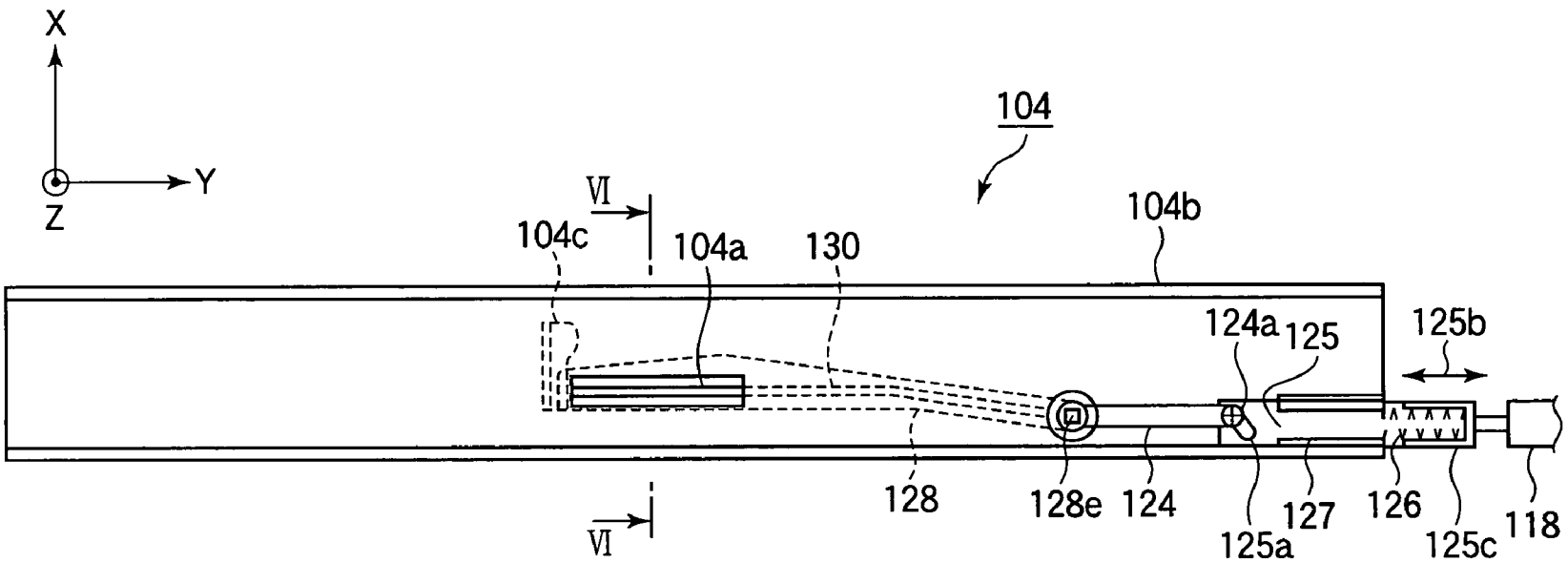
FIG. 5 is a top view of a main part of a developing device according to the second embodiment.

FIG. 5 is a top view of the main part of the developing device 104 according to the second embodiment. In FIG. 5, a shutter 128 of the second embodiment is made of a plate metal such as stainless steel (SUS). The shutter 128 is provided below the supply opening 104*a* to open and close the supply opening 104*a*. As was described in the first embodiment, one end (first end) of the shutter 128 is guided by the guide member 104*c* in the direction of X-axis, and the other end (second end) of the shutter 128 is connected to the lever 124. A projection 128*e* is formed on the second end of the shutter 128, and projects outside the developing device 104 in the direction of Z-axis. The projection 128*e* functions as a fulcrum of the shutter 128 and the lever 124, so that the shutter 128 and the lever 124 rotate together with each other with no phase difference.

As in the first embodiment, the lever 124 has the projection 124*a* formed on the opposite end to the projection 128*e*. The projection 124*a* is inserted in the groove 125*a* formed on the slide member 125 so that the projection 124*a* is slidable in the groove 125*a*. The end 125*c* of the slide member 125 projects outside the developing device 104 in the direction of Y-axis, and is fixed to the plunger of the solenoid 118.

Figure 6:
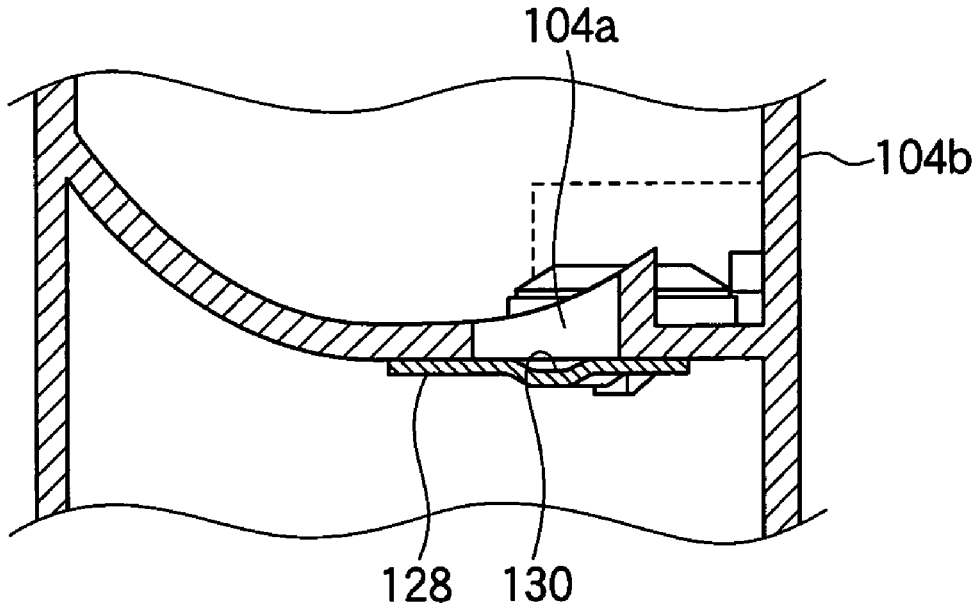
FIG. 6 is sectional view taken along line VI-VI shown in FIG. 5.
Figure 6:
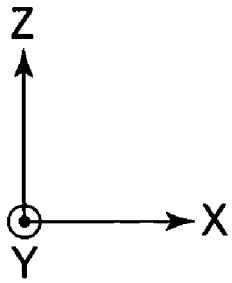

FIG. 6 is a cross section taken along line VI-VI shown in FIG. 5. As shown in FIGS. 5 and 6, a recessed groove 130 is formed substantially on the center portion of the shutter 128 in the width direction. The groove 130 is recessed downwardly, so that the groove 130 faces the supply opening 104*a*. The groove 130 is elongated in the longitudinal direction of the shutter 128.

The operation and the advantage of the shutter 128 of the second embodiment are the same as those of the first embodiment, and therefore the duplicate explanation is omitted.

In the second embodiment, because of the groove 130 formed on the shutter 128, the shutter 128 has a rigidity against deflection even when the shutter 128 is made of a thin metal plate such as stainless steel having the thickness from 0.3 to 0.5 mm. Therefore, even when a large amount of toner is accumulated on the shutter 128 and a large pressure is applied to the shutter 128, the deflection of the shutter 128 can be minimized. Thus, a load for opening and closing the shutter 128 can be reduced. As a result, a load of the driving source for operating the shutter 128 can be reduced.

Third Embodiment

Figure 7:
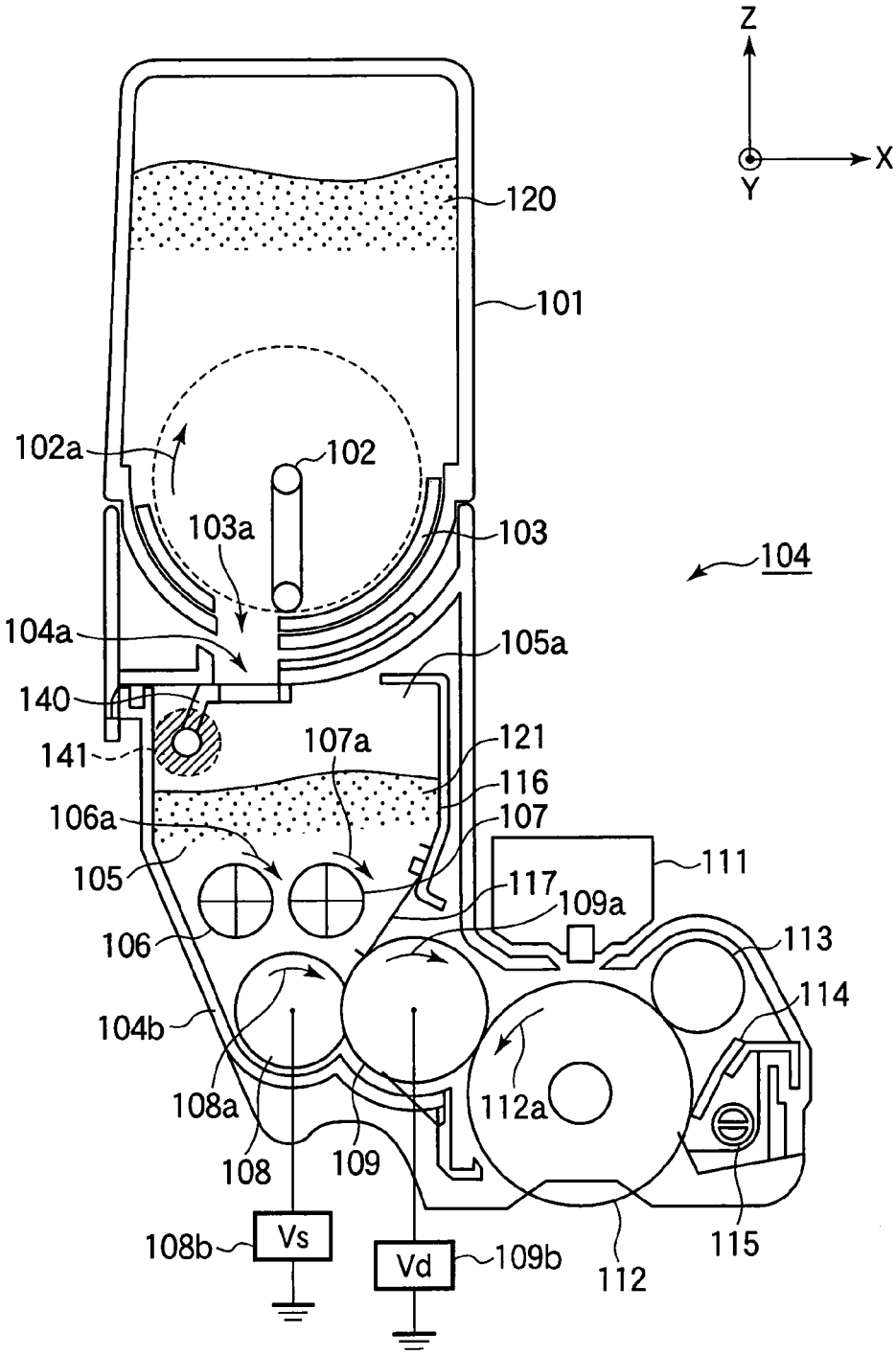
FIG. 7 is a sectional side view of a developing device according to the third embodiment.
Figure 8:
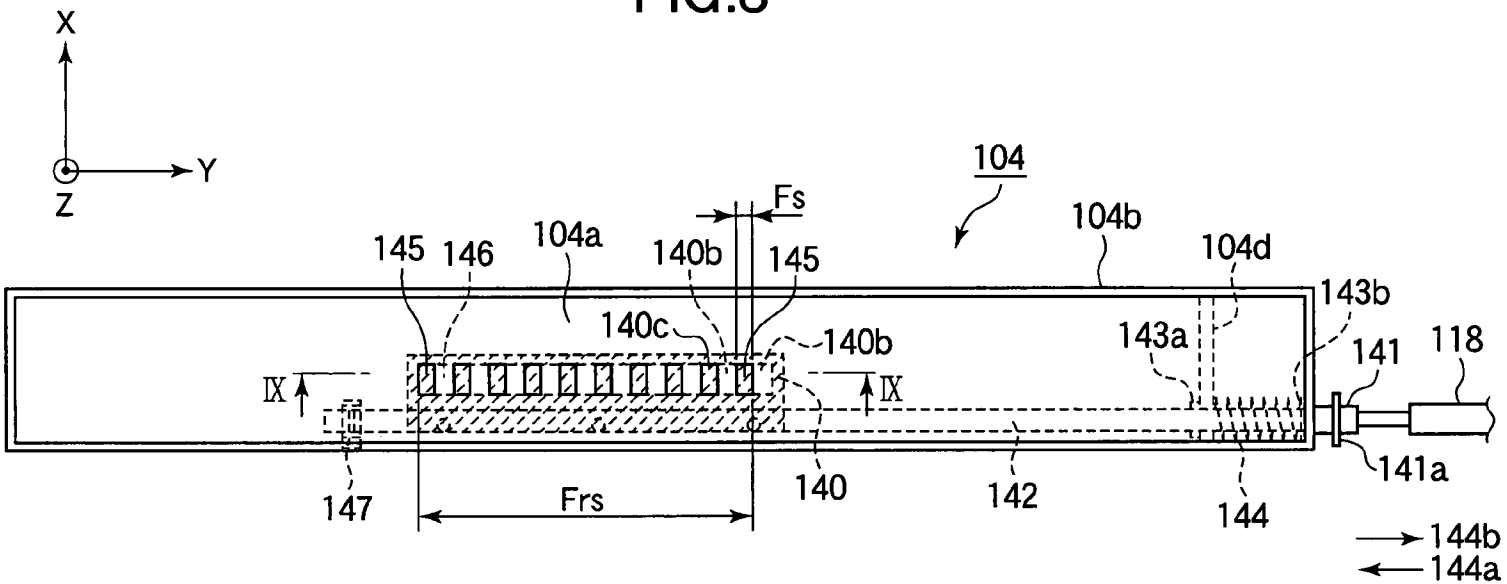
FIG. 8 is a top view of a main part of the developing device according to the third embodiment.

FIG. 7 is a sectional side view of the developing device 104 according to the third embodiment. FIG. 8 is a top view of the main part of the developing device 104 according to the third embodiment. As shown in FIGS. 7 and 8, a shutter 140 of the third embodiment is provided below the supply opening 104*a* to open and close the supply opening 104*a*. The shutter 140 includes a plate portion 140*a* which is knee-shaped as seen in the direction of Y-axis, and a shaft portion 142 fixed to the plate portion 140*a*. As shown in FIG. 8, an end 141 of the shaft portion 142 projects outside the developing device 104 in the direction of Y-axis. The end 141 of the shutter 140 is fixed to the plunger of the solenoid 118, and is urged in the direction indicated by an arrow 144*a*.

As shown in FIG. 8, the shaft portion 142 is provided in the developing device 104. The shaft portion 142 is rotatably supported by the outer wall 104*b* and a fixing member 147 of the developing device 104 so that the shaft portion 142 is slidable in the longitudinal direction of the developing device 104 (i.e., Y-axis). A stopper 141*a* is fixed to the end 141 of the shaft portion 142 that projects outside the developing device 104 in the direction of Y-axis. A toner storing portion wall 104*d* is formed in the developing device 104. A resilient member (for example, a spring) 144 is provided in a space between the toner storing portion wall 104*d* and the outer wall 104*b* on the side portion of the developing device 104. The resilient member 144 is sandwiched between a stopper 143*a* (fixed to the toner storing portion wall 104*d*) and a stopper 143*b* (fixed to the shaft portion 142). The resilient member 144 urges the shaft portion 142 in the direction indicated by an arrow 144*b*.

Figure 9:
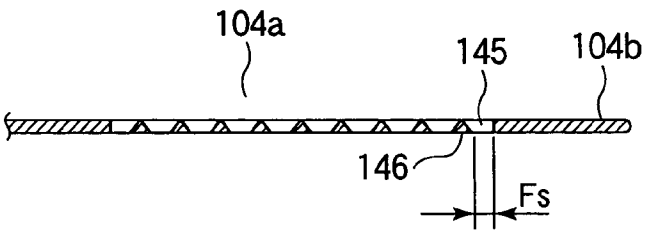
FIG. 9 is a sectional view taken along line IX-IX in FIG. 8.

A plurality of small openings 140*b* are formed on the plate portion 140*a* of the shutter-140. The openings 140*b* are arranged in the longitudinal direction of the developing device 104 at constant intervals. A plurality of spacing portions 104*c* are formed between adjacent openings 140*b*. The width of each spacing portion 140*c* is the same as the opening 140*b*. Moreover, the supply opening 104*a* of the developing device 104 is formed by a plurality of small openings 145 arranged in the longitudinal direction of the developing device 104 at constant intervals. The size of the opening 145 of the developing device 104 is the same as that of the opening 140*b* of the shutter 140. The size of each spacing portion 146 between the adjacent openings 145 is the same as that of the opening 145. The positions of the openings 145 (in the direction of the width of the developing device 104) are the same as those of the openings 140*b* of the shutter 140. Further, the number of the openings 145 is the same as that of the openings 140*b*. FIG. 9 is a cross section taken along line IX-IX shown in FIG. 8. As shown in FIG. 9, the spacing portion 146 is hump-shaped and has an apex directed upward, so that the toner is not accumulated on the spacing portion 146.

In a state as shown in FIG. 8, the openings 140*b* of the shutter 140 are aligned with the spacing portions 146 of the developing device 104, and the spacing portions 140*c* of the shutter 140 are aligned with the openings 145 of the developing device 104. That is, the supply opening 104*a* is closed. The other components of the third embodiment is the same as those of the first embodiment.

Figure 10:
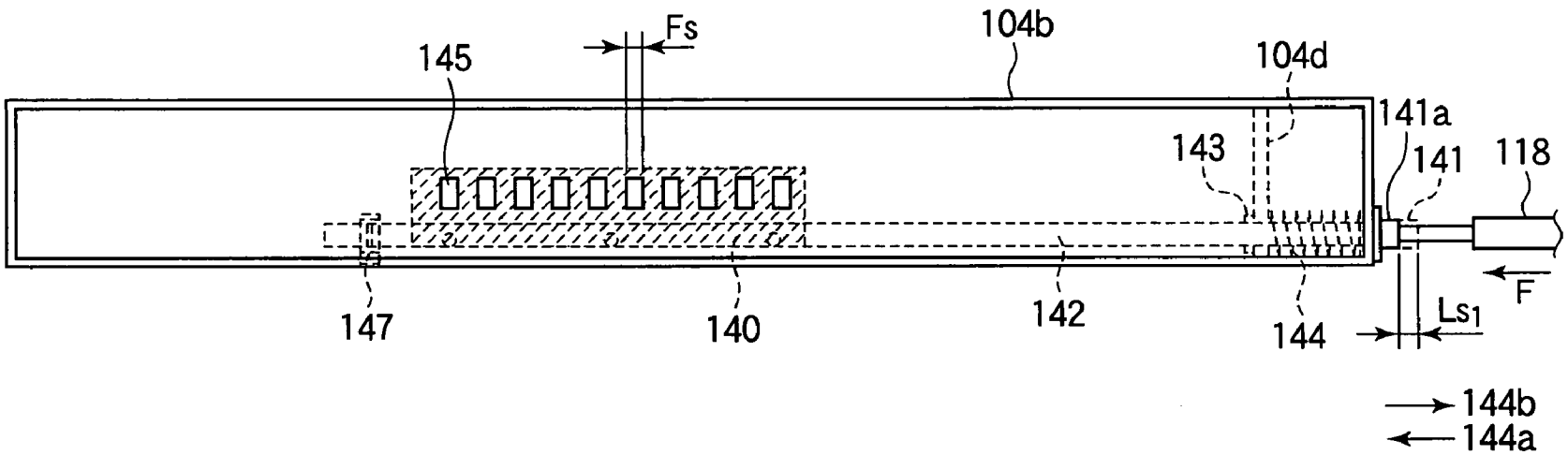
FIG. 10 is a top view showing an operation of the developing device according to the third embodiment.

Next, the operation of the developing device 104 of the third embodiment will be described with reference to FIG. 10. FIG. 10 is a top view showing the operation of the developing device 104 of the third embodiment. As was described in the first embodiment, the toner container 101 is attached to the developing device 103, and the supply opening 103*a* is opened. The toner amount detection sensor 190 (FIG. 19) is provided for detecting the amount of the toner 121 in the hopper 105.

Based on the toner amount detection sensor 190 (FIG. 19), when the amount of the toner 121 in the hopper 105 is less than the predetermined amount, the controller (not shown) of the developing device drives the solenoid 118 to apply the force F to the end 141 of the shaft portion 142 in the direction indicated by the arrow 144*a* as shown in FIG. 10. Because of the force F, the shaft portion 142 moves a distance Ls1 in the same direction. The moving amount Ls1 is the same as the width Fs of the opening 145 of the supply opening 104*a* (Ls1=Fs). The moving amount Ls1 is set by adjusting the position of the stopper 141*a* at the end 141 of the shaft portion 142.

Because of the movement of the shaft portion 142, the plate portion 140*a* (i.e., the shutter 140) moves to a position where the openings 140*b* of the shutter 140 are aligned with the openings 145 of the developing device 104, i.e., the supply opening 104*a* is opened. Thus, the toner 120 (FIG. 7) stored in the toner container 101 is allowed to fall in the interior of the hopper 105. In a state where the supply opening 104*a* of the developing device 104 is opened, the agitating bar 102 in the toner container 101 rotates in the direction indicated by the arrow 102*a*, and the toner 120 stored in the toner container 101 is supplied to the hopper 105 through the supply opening 104*a*. The supplied toner 121 is stored in the hopper 105.

Based on the toner amount detection sensor 190 (FIG. 19), when the amount of the toner 121 in the hopper 105 is greater than or equals to the predetermined amount, the controller stops driving the solenoid 118, so that the shaft portion 142 of the shutter 140 moves in the direction indicated by an arrow 144*b* by the force of the resilient member 144, as shown in FIG. 8. As a result, the plate portion 140*a* of the shutter 140 returns to a position shown in FIG. 8, where the openings 140*b* of the shutter 140 are aligned with the spacing portions 146 of the developing device 104, i.e., the supply opening 104*a* is closed. With such an operation, the amount of the toner 121 in the hopper 105 can be maintained within a suitable range. The printing operation in the third embodiment is the same as that in the first embodiment, and therefore the duplicate explanation is omitted.

As described above, according to the third embodiment, when the amount of the toner 121 in the hopper 105 is less than the predetermined amount, the shutter 140 opens the supply opening 104*a* to supply the toner to the hopper 105. When the amount of the toner in the hopper 105 is greater than or equals to the predetermined amount, the shutter 140 closes the supply opening 104*a* to stop the supply of the toner. Thus, it is ensured that a sufficient space 105*a* is formed in the hopper 105 as shown in FIG. 7, and therefore the increase of the density of the toner 121 in the hopper 105 is prevented. Accordingly, the pressure increase of the toner 121 in the hopper 105 is prevented. As a result, the formation of the thin toner layer on the developing roller 109 and the charging of the toner by the developing blade 117 are suitably performed, with the result that the printing quality is enhanced.

Moreover, in the third embodiment, the openings 145 and 140*b* are formed on the supply opening 104*a* and the shutter 140. Thus, the whole length Frs (FIG. 8) of the supply opening 104*a* can be longer than the length of the supply opening (for example, the supply opening 104*a* of the first embodiment) consisting of one opening, if the whole opening areas thereof are equal to each other. Therefore, the supplied toner 121 can be distributed uniformly in the longitudinal direction of the developing device 104. In other words, the concentration of the supplied toner 121 at the center portion of the developing device 104 can be prevented. As a result, the printing quality can be enhanced.

Fourth Embodiment

Figure 11:
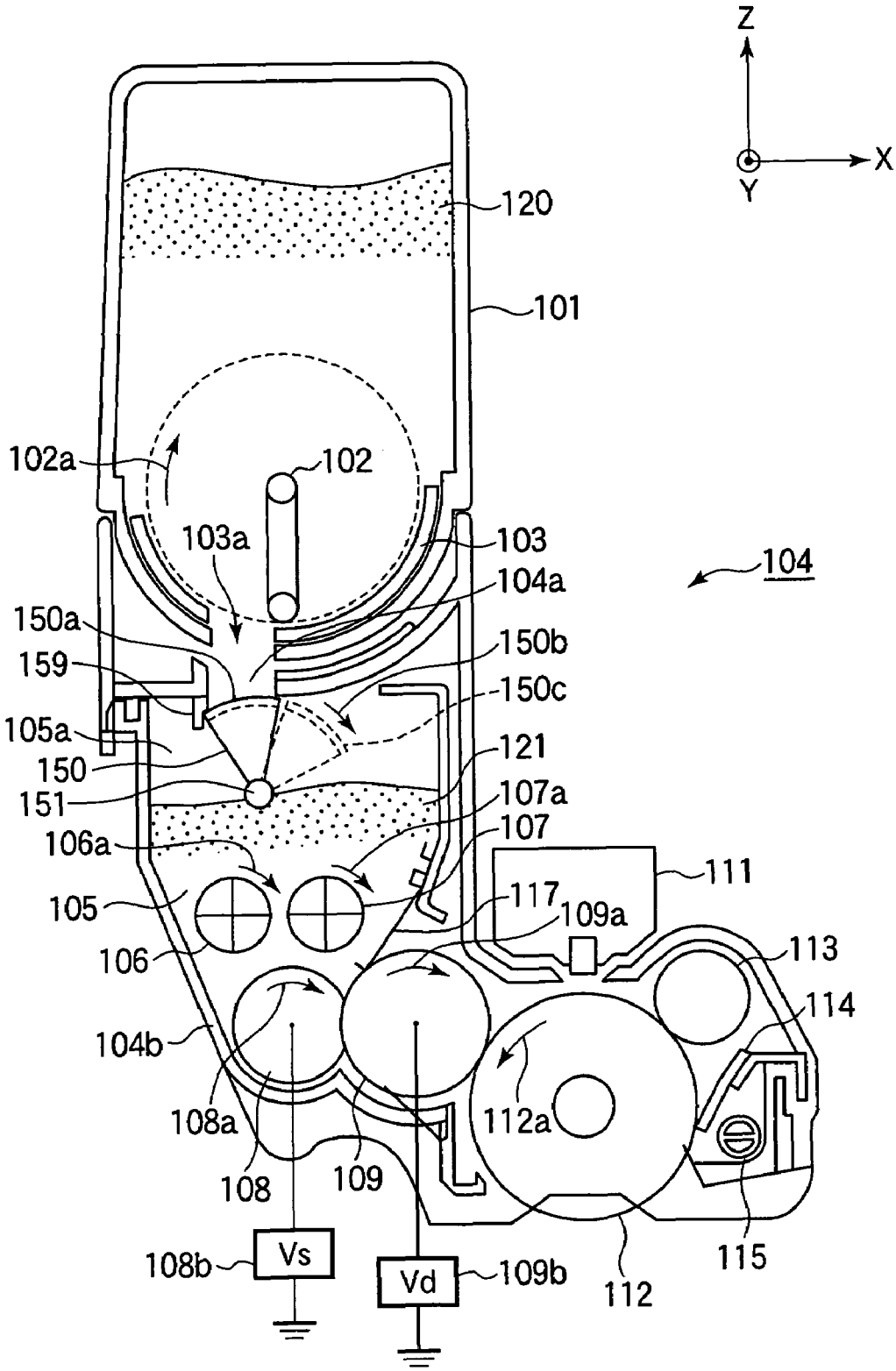
FIG. 11 is a sectional side view of a developing device according to the fourth embodiment.
Figure 12:
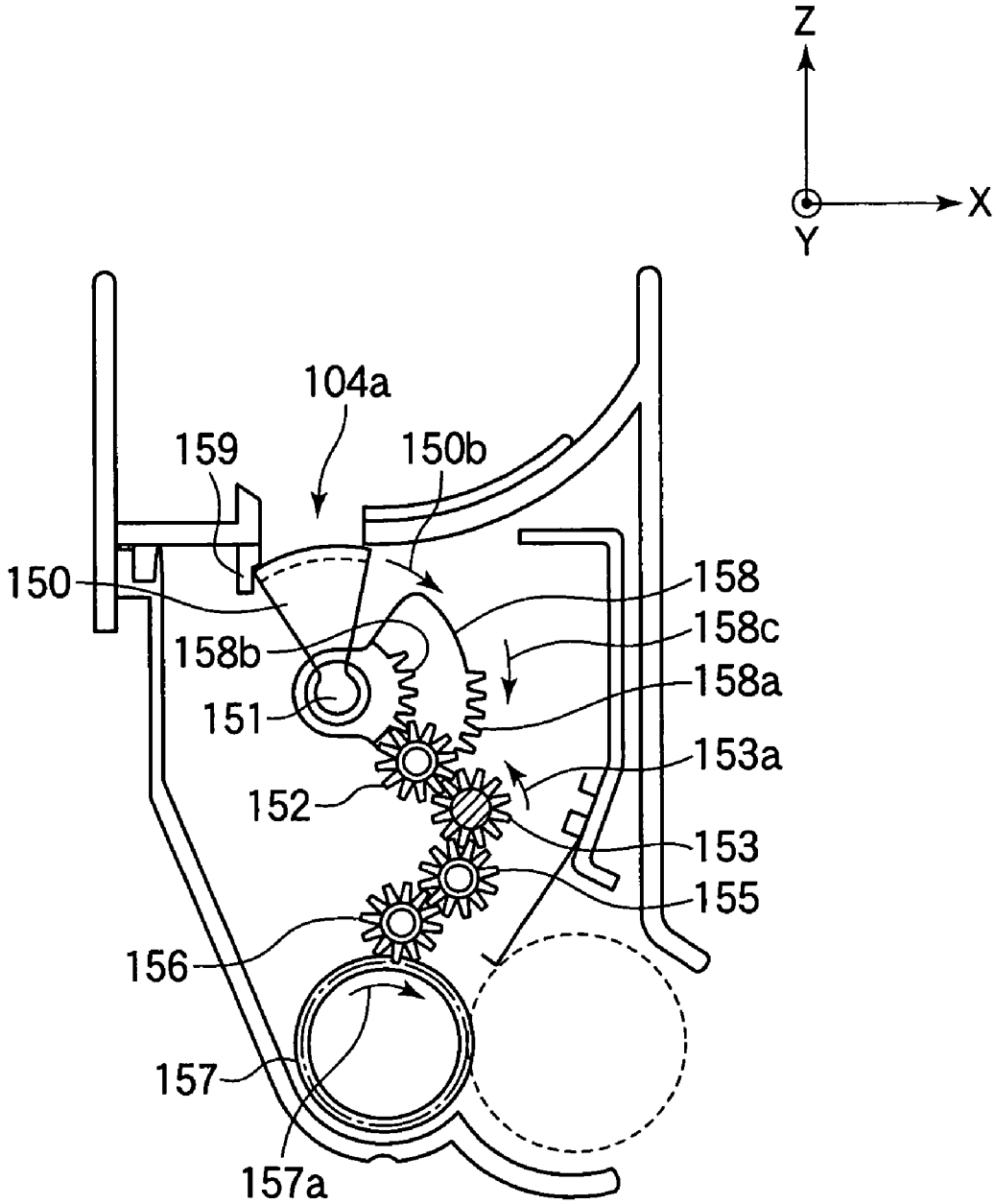
FIG. 12 is a sectional side view of a main part of the developing device according to the fourth embodiment.

FIG. 11 is a sectional side view of the developing device 104 according to the fourth embodiment. FIG. 12 is a sectional side view of the main part of the developing device 104 according to the fourth embodiment. As shown in FIGS. 11 and 12, a shutter 150 of the fourth embodiment is provided below the supply opening 104*a* of the developing device 104 to open and close the supply opening 104*a*. The shutter 150 is in the shape of a sector as seen in the direction of Y-axis, and has a shutter face 150*a* in the shape of an arc as seen in the direction of Y-axis. The shutter 150 is fixed to a fulcrum member 151 rotatable as shown by an arrow 150*b*. The shutter face 150*a* has a sufficient surface area to close the supply opening 104*a* when the shutter 150 is in a position shown by a solid line in FIG. 11. As an alternative structure of the shutter 150, the shutter face 150*a* can be made of a plate member whose ends are supported. Further, it is also possible that the shutter 150 is in the shape of a hollow box.

A stopper 159 is provided below the supply opening 104*a*, for stopping the rotation of the shutter 150. In a state where the shutter 150 abuts against the stopper 159, the shutter face 150*a* closes the supply opening 104*a*.

FIG. 12 shows a shutter driving mechanism for driving the shutter 150. In FIG. 12, the shutter driving mechanism is provided on the inner surface of the developing device 104, and is located on the outside of the toner storing portion wall 104*d* (FIG. 8). The fulcrum member 151 (to which the shutter 150 is fixed) extends in the direction of Y-axis. A sector gear 158 is fixed to an end of the fulcrum member 151. There is a phase difference between the rotational positions of the sector gear 158 and the shutter 150. The sector gear 158 includes an outer gear 158*a* and an inner gear 158*b* coaxial with each other.

Figure 13:
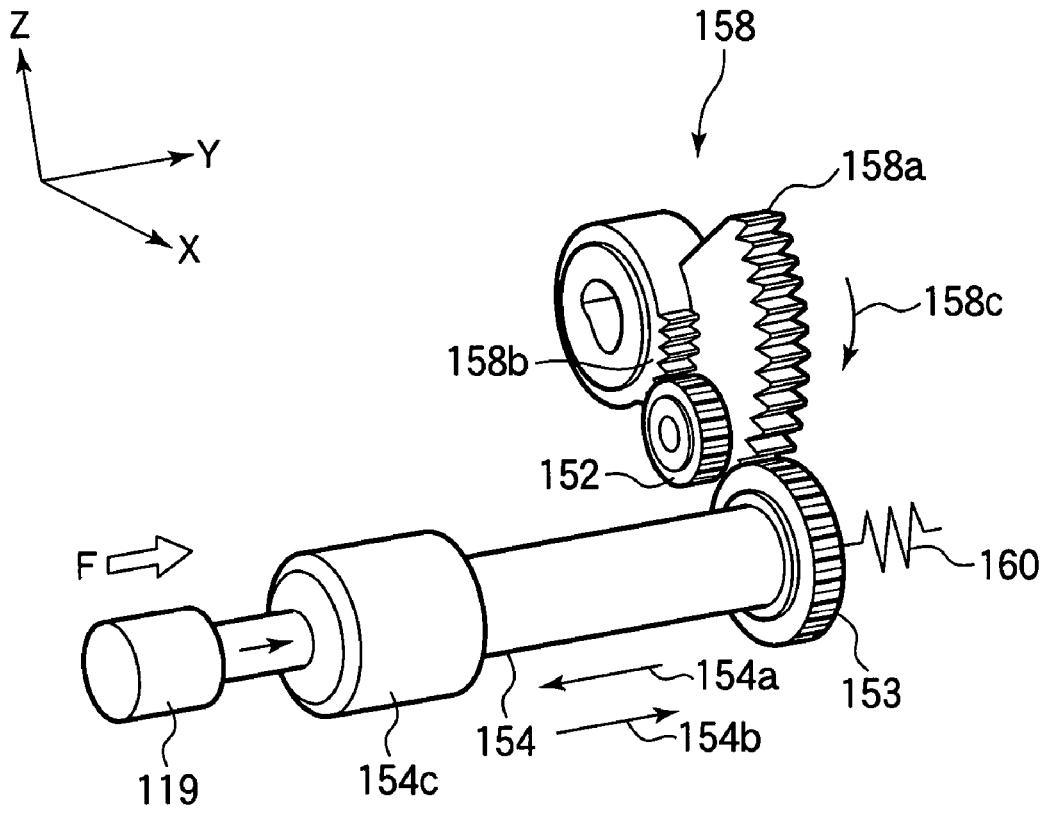
FIG. 13 is a perspective view of a shutter driving mechanism of the developing device according to the fourth embodiment.

FIG. 13 is a perspective view of the shutter driving mechanism of the fourth embodiment. An idle gear 152 is rotatably provided on the same side as the inner gear 158*b* of the sector gear 158, and engages the inner gear 158*b*. The idle gear 152 is able to engage a slide gear (i.e., a movable gear) 153. The slide gear 153 is fixed to a shaft 154 movable in the direction of Y-axis. The shaft 154 is urged by a spring 160 in the direction indicated by an arrow 154*a*. The slide gear 153 selectively engages one of the idle gear 152 and the outer gear 158*a* of the sector gear 158. A force F is applied to the end 154*c* of the shaft 154 by a solenoid 119. When the force F is applied to the shaft 154, the slide gear 153 engages the outer gear 158*a*. When the force F is not applied to the shaft 154, the slide gear 153 engages the idle gear 152.

As shown in FIG. 12, the slide gear 153 engages an idle gear 155, and the idle gear 155 engages another idle gear 156. The length (width) of the idle gear 155 in the axial direction thereof is longer than the moving range of the slide gear 153, so that the idle gear 155 engages the slide gear 153 irrespective of the position of the slide gear 153 in the direction of Y-axis. The idle gear 156 engages a supply roller gear 157 coaxial with the supply roller 108. The other components are the same as those of the first embodiment.

Figure 14:
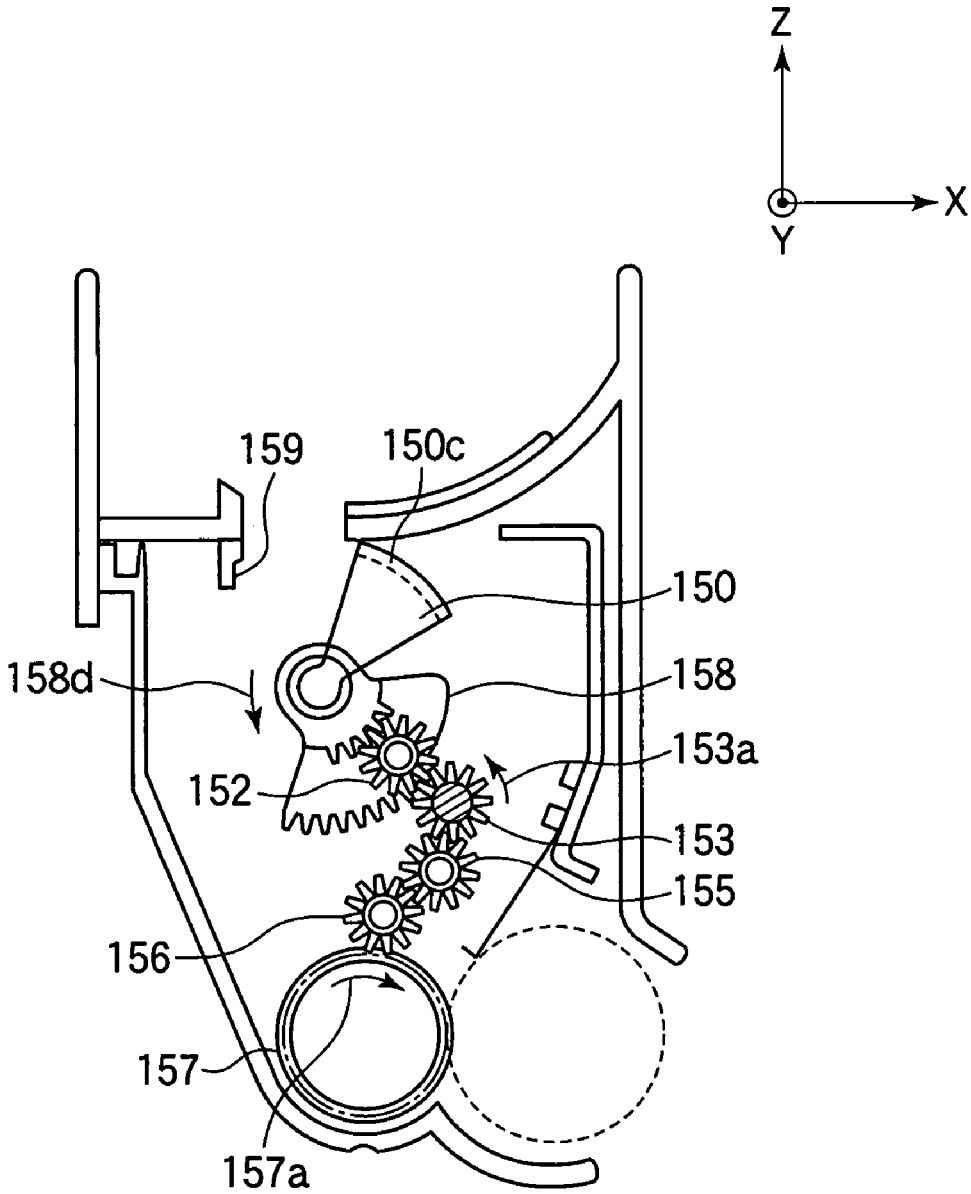
FIG. 14 is a sectional side view of an operation of the developing device according to the fourth embodiment.

Next, the operation of the developing device of the fourth embodiment will be described with reference to FIGS. 12 through 14. FIG. 14 is a sectional side view showing the operation of the developing device 104 of the fourth embodiment. As was described in the first embodiment, the toner container 101 is attached to the developing device 104, and the supply opening 103*a* is opened. The toner amount detection sensor 190 (FIG. 19) is provided for detecting the amount of the toner 121 in the hopper 105.

Based on the toner amount detection sensor 190 (FIG. 19), when the amount of the toner 121 in the hopper 105 is less than the predetermined amount, the controller (not shown) of the developing device 104 drives the solenoid 119 to apply the force F to the end 154*c* of the shaft 154 in the direction indicated by an arrow 154*b* as shown in FIG. 13. Before the force F is applied to the shaft 154, the slide gear 153 engages the idle gear 152. When the force F is applied to the shaft 154, the shaft 154 moves in the direction indicated by the arrow 154*b*, and the slide gear 153 engages the outer gear 158*a* of the sector gear 158.

The supply roller 108 in the developing device 104 is rotated by a driving force transmitted from the not shown driving source. The rotation of the supply roller 108 is transmitted to the slide gear 153 via the supply roller gear 157 and the idle gears 156 and 155. By the engagement of the slide gear 153 and the outer gear 158*a* of the sector gear 158, the rotation is further transmitted to the sector gear 158, and the sector gear 158 rotates in the direction indicated by the arrow 158*c* as shown in FIGS. 12 and 13. The supply roller gear 157 rotates in only one direction indicated by an arrow 157*a* (FIG. 12).

Because of the rotation of the sector gear 158, the shutter 150 rotates in the direction indicated by the arrow 150*b* (FIG. 12). The shutter 150 rotates to a position shown in FIG. 14 where the shutter 150 opens the supply opening 104*a*. In a state where the shutter 150 rotates to this position, the engagement of the slide gear 153 and the outer gear 158*a* is released. This is because the outer gear 158*a* has teeth formed in a limited area, and the teeth disengage from the slide gear 153 when the shutter 150 reaches to a position shown in FIG. 14. Although the slide gear 153 further continues to rotate, the rotation is not transmitted to the outer gear 158*a*. Therefore, the shutter 150 stops at a position shown in FIG. 14. Because of this rotation of the shutter 150, the toner in the toner container 101 is allowed to fall in the interior of the hopper 105.

In a state where the supply opening 104*a* of the developing device 104 is opened, the agitating bar 102 rotates in the direction indicated by the arrow 102*a* (FIG. 11), and the toner 120 is supplied from the toner container 101 to the hopper 105 through the supply opening 104*a*. The supplied toner is stored in the hopper 105.

Based on the toner amount detection sensor 190 (FIG. 19), when the amount of the toner 121 is greater than or equals to the predetermined amount, the controller stops driving the solenoid 119, so that the force F shown in FIG. 13 disappears. As a result, the shaft 154 moves in the direction indicated by the arrow 154*a* (FIG. 13) by the force of the spring 160, and the slide gear 153 engages the idle gear 152. The movement of the shaft 154 is stopped by a not shown stopper in a state where the slide gear 153 engages the idle gear 152.

While the supply roller 108 is rotating, the slide gear 153 keep rotating, and the rotation of the slide gear 153 is transmitted to the inner gear 158*b* of the sector gear 158 via the idle gear 152. The inner gear 158*b* rotates in the direction indicated by an arrow 158*d* shown in FIG. 14, and the shutter 150 rotates in the same direction. Therefore, the shutter 150 rotates to a position below the supply opening 104*a* and abuts against the stopper 159 as shown in FIG. 12. As a result, the supply opening 104*a* is closed.

In a state where the shutter 150 abuts against the stopper 159, the engagement of the idle gear 152 and the inner gear 158*b* is released. This is because the inner gear 158*b* has teeth formed in a limited area, and the teeth disengage from the idle gear 152 when the shutter 150 reaches to a position shown in FIG. 12. With such an operation, the amount of the toner 121 in the hopper 105 can be maintained within a suitable range. The printing operation of the fourth embodiment is the same as that of the first embodiment, and therefore duplicate explanation is omitted. Because the load applied to the spring 160 shown in FIG. 13 (for sliding the slide gear 153) is relatively small, the spring 160 can be made of a weak spring whose spring force is less than 30 gf.

As described above, according to the fourth embodiment, when the amount of the toner 121 in the hopper 105 becomes less than the predetermined amount, the shutter 150 opens the supply opening 104*a* to supply the toner to the developing device 104. When the amount of the toner 121 in the hopper 105 is greater than or equals to the predetermined amount, the shutter 150 closes the supply opening 104*a* to stop the supply of the toner. Thus, it is ensured that a sufficient space 105*a* is formed in the hopper 105 as shown in FIG. 11, and therefore the increase of the density of the toner in the hopper 105 is prevented. Accordingly, the pressure increase of the toner in the hopper 105 is prevented. As a result, the formation of the thin toner layer on the developing roller 109 and the charging of the toner by the developing blade 117 are suitably performed, with the result that the printing quality is enhanced.

In the fourth embodiment, it is possible to move the shaft 154 (to which the slide gear 153 is fixed) by means of a driving source of the image forming apparatus, without providing the solenoid 119. Because a driving force for moving the shaft 154 is substantially the same as the force of the spring 160, it is possible to use an inexpensive driving source that generates a relatively weak driving force.

Fifth Embodiment

Figure 15:
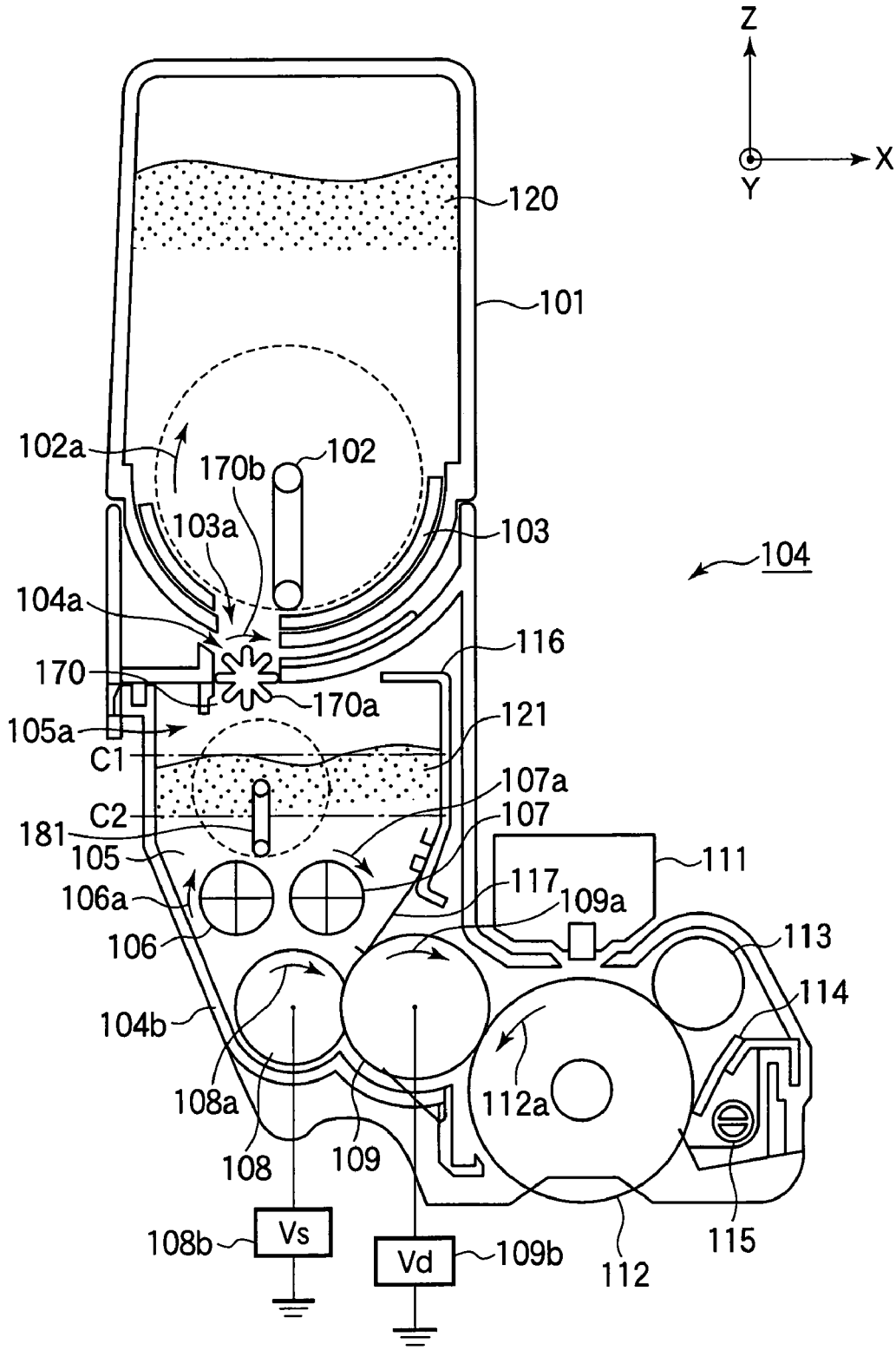
FIG. 15 is a sectional side view of a developing device according to the fifth embodiment.
Figure 16:
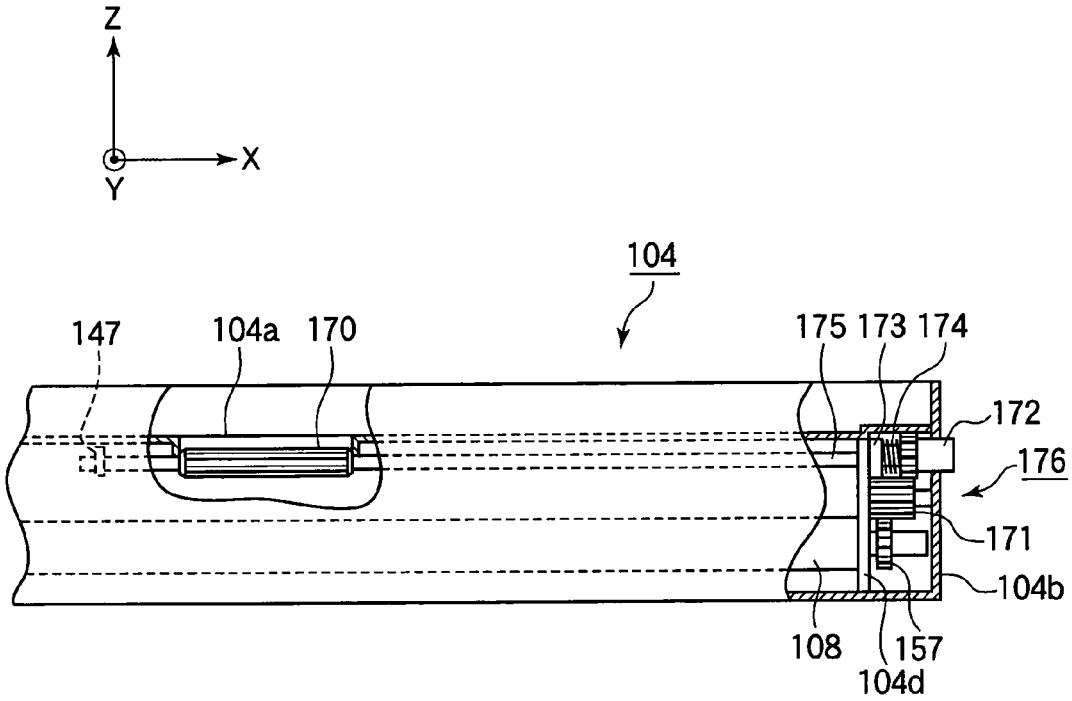
FIG. 16 is a rear view of a main part of the developing device according to the fifth embodiment.

FIG. 15 is a sectional side view of a developing device 104 according to the fifth embodiment. FIG. 16 is a rear view of the main part of the developing device 104 according to the fifth embodiment. As shown in FIGS. 15 and 16, a toner agitator (i.e., a first agitating member) 170 is provided in the supply opening 104*a* of the developing device 104 so that the toner agitator 170 closes the supply opening 104*a*. The toner agitator 170 is rotatably supported in the supply opening 104*a*. The toner agitator 170 has a plurality of blades (in this example, eight blades) 170*a*. The distance between tips of the opposite two blades 170*a* (i.e., the diameter of the toner agitator 170) is slightly less the width of the supply opening 104*a*. The gap between the tip of the blade 170 and the end surface of the supply opening 104*a* is set to be less than or equals to 1 mm. In a state where the toner agitator 170 stops rotating, the toner agitator 170 prevents the toner 120 from falling in the interior of the developing device 104. In other words, the toner agitator 170 acts as a shutter of the supply opening 104*a*.

As shown in FIG. 16, the toner agitator 170 is fixed to a shaft 175. The shaft 175 is rotatably supported by the fixing member 147 and the toner storing portion wall 104*d* in the developing device 104. The toner agitator 170 is located in the supply opening 104*a*. A coupling mechanism 176 is provided on the outside (i.e., the right side in FIG. 16) of the toner storing portion wall 104*d* in the developing device 104.

Figure 17:
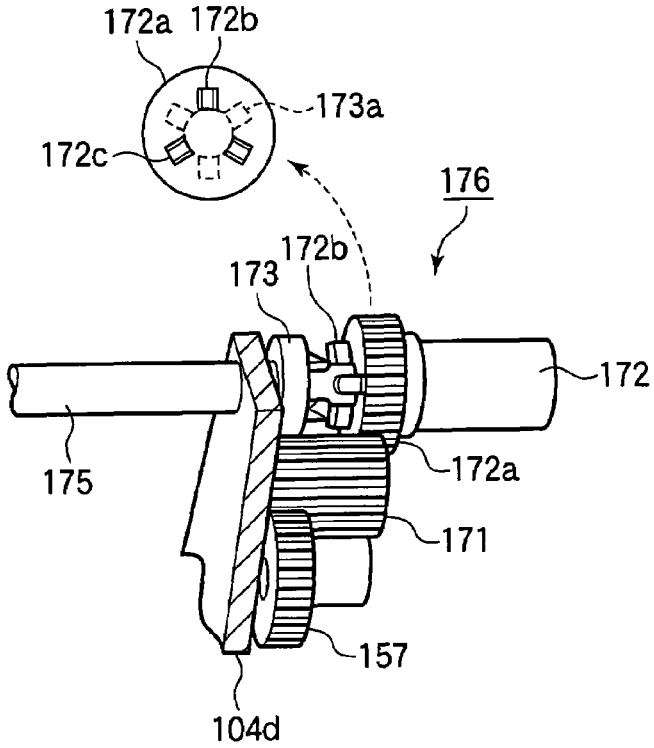
FIG. 17 is a perspective view of a coupling mechanism of the developing device according to the fifth embodiment.
Figure 18A:
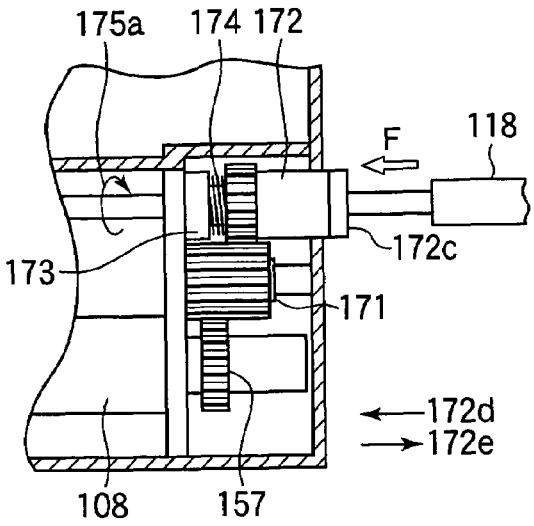
FIGS. 18A and 18B are sectional rear views showing an operation of the coupling mechanism of the developing device according to the fifth embodiment.
Figure 18B:
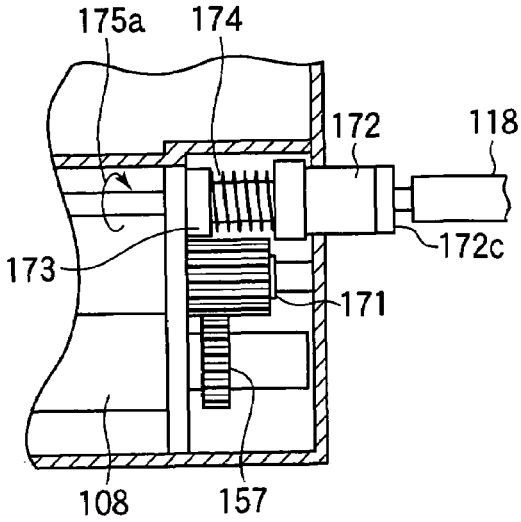

FIG. 17 is a perspective view of a coupling mechanism in the fifth embodiment. FIGS. 18A and 18B are sectional views of the coupling mechanism. As shown in FIGS. 17 and 18A, a receiving member 173 is provided on the end of the shaft 175. A coupling gear 172 is provided in opposition to the receiving member 173 so that the coupling gear 172 and the receiving member 173 are coaxial with each other. The coupling gear 172 has a gear portion 172*a* and a coupling portion 172*b*. The coupling portion 172*b* engages the receiving member 173 so as to transmit the rotation of the coupling gear 172 to the receiving member 173. A spring 174 is provided between the receiving member 173 and the gear portion 172*a*. The spring 174 urges the receiving member 173 and the gear portion 172 in the directions away from each other.

As schematically shown in FIG. 17, the coupling portion 172*b* includes a plurality of projections 172*c* that alternately engage a plurality of projections 173*a* of the receiving member 173, and therefore the rotation can be transmitted between the coupling portion 172*b* and the receiving member 173. In FIG. 17A, the projections 173*a* of the receiving member 173 are diagrammatically illustrated. The gear portion 172*a* engages an idle gear 171, and the idle gear 171 engages the supply roller gear 157. The rotation of the supply roller gear 157 is transmitted to the coupling gear 172, and further transmitted to the shaft 175 by the engagement of the coupling mechanism 176.

Figure 19:
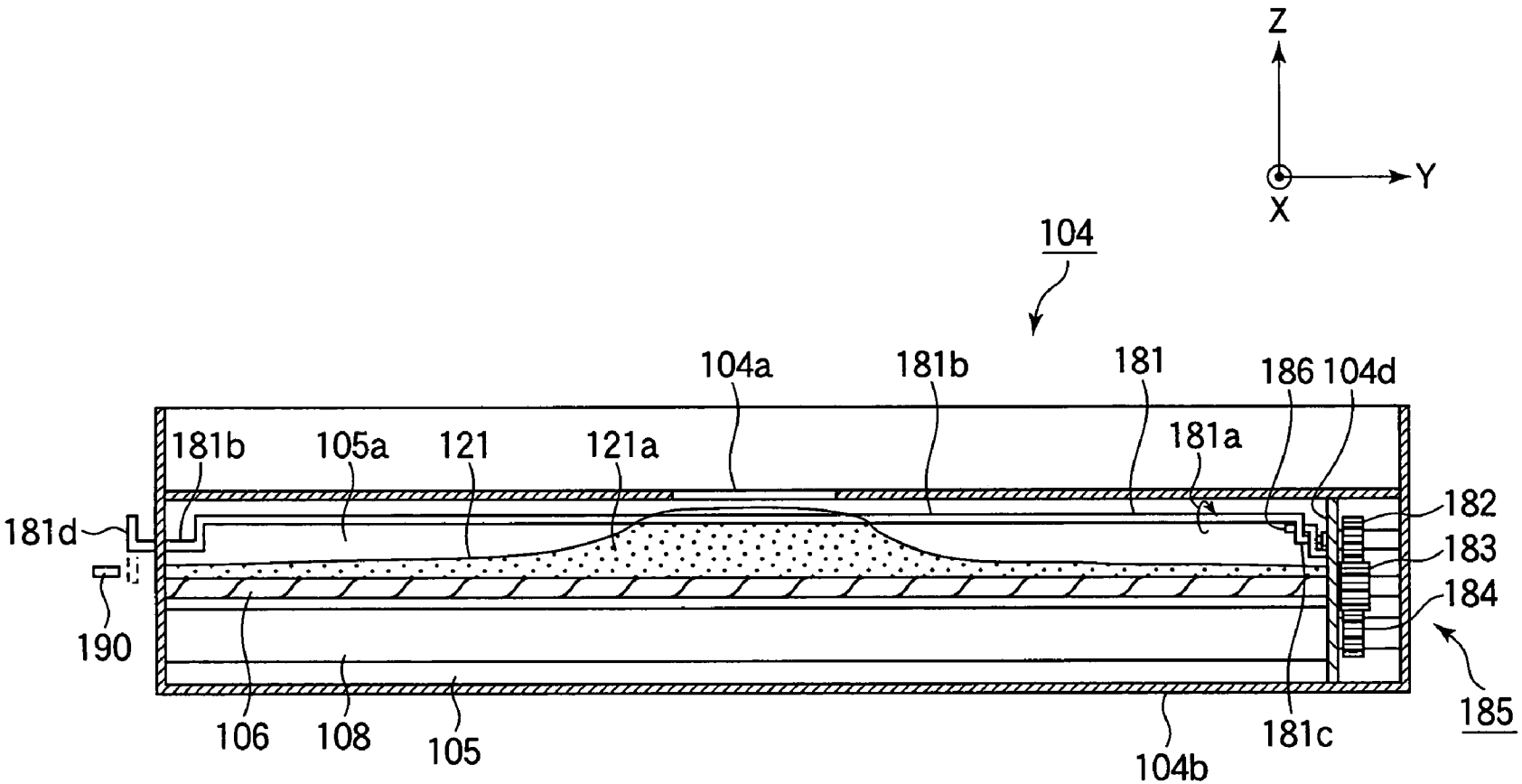
FIG. 19 is a sectional rear view of a main part of the developing device according to the fifth embodiment.

FIG. 19 shows a crank bar (i.e., a second agitating member) 181 for agitating the toner 121 in the hopper 105. In FIG. 19, the above described toner agitator 170 is omitted. The crank bar 181 is provided in the hopper 105 and is located below the supply opening 104*a*. The crank bar 181 is crank-shaped, and is rotatable about an axis parallel to the longitudinal direction of the developing device 104 (i.e., Y-axis). In particular, the crank bar 181 includes a linearly elongated center portion 181*b* and two coaxial end portions 181*c* which are eccentrically parallel to the center portion 181*b*. The end portions 181*c* define the rotation axis of the crank bar 181, and are supported by the toner storing portion wall 104*d* and the outer wall 104*b*. A transmission mechanism 185 for rotating the crank bar 181 is provided on the outside of the toner storing portion wall 104*d*. The transmission mechanism 185 includes a supply roller gear 184, an agitating screw gear 183 (for rotating the above described agitating screw 106) that engages the supply roller gear 184, and a gear 182 that engages the gear 183. The supply roller gear 184 rotates together with the supply roller 108, and the rotation of the supply roller 108 is transmitted to the crank bar 181 via the gears 183 and 182.

The crank bar 181 is driven by a boss 186 fixed to the gear 182. The boss 186 rotates at a constant speed. The crank bar 181 is urged by the boss 186 and rotates to the uppermost position. After the crank bar 181 rotates to the uppermost position, the crank bar 181 separates from the boss 186 and freely rotates downward (to the lowermost position) by its own weight. The time of the free rotation of the crank bar 181 (from the uppermost position to the lowermost position) depends on the amount of the toner 121 in the hopper 105, and therefore the amount of the toner 121 in the hopper 105 is detected by measuring the time of the rotation of the crank bar 181. The toner amount detection sensor 190 is provided on the outside of the hopper 105, and is located at a position corresponding to the lowermost position of the crank bar 181. The crank bar 181 has a reflection surface 181*d* at an end thereof that faces the toner amount detection sensor 190. The toner amount detection sensor 190 is turned ON when the crank bar 181 is in the lowermost position, and turned OFF when the crank bar 181 is not in the lowermost position. The time of the rotation of the crank bar 181 is measured based on ON/OFF signal from the toner amount detection sensor 190. When the measured time is shorter than the predetermined time, the controller (not shown) of the developing device determines that the amount of the toner 121 is less than the predetermined amount (for example, as a level C2 in FIG. 15), and drives the agitator 170 to supply toner to the hopper 105 until the amount of the toner 121 is sufficient (for example, as a level C1 in FIG. 15).

Next, the operation of the developing device 104 of the fifth embodiment will be described. As was described in the first embodiment, the toner container 101 is attached to the developing device 104, and the supply opening 103*a* is opened. Based on the toner amount detecting sensor 190, when the amount of the toner 121 in the hopper 105 is less than the predetermined amount, the controller (not shown) drives the solenoid 118 to apply the force F to the end 172*c* of the coupling gear 172 in the direction indicated by an arrow 172*d* (FIG. 18A) Before the force F is applied to the coupling gear 172, the coupling gear 172 does not engages the receiving member 173 because of the force of the spring 174. When the force F is applied to the coupling gear 172, the coupling gear 172 moves in the direction indicated by the arrow 172*d*, and the coupling gear 172 engages the receiving member 173.

The supply roller 108 is rotated by a driving force transmitted from the not shown driving source. The rotation of the supply roller 108 is transmitted to the coupling gear 172 via the supply roller gear 157 and the idle gear 171. By the engagement of the coupling gear 172 and the receiving member 173, the rotation is further transmitted to the shaft 175 (via the receiving member 173), and the shaft 175 rotates in the direction indicated by an arrow 175*a* (FIG. 18A). The supply roller gear 157 rotates in only one direction indicated by an arrow 157*a* (FIG. 12).

Because of the rotation of the shaft 175, the toner agitator 170 rotates in the direction indicated by an arrow 170*b* (FIG. 15). The toner 120 exists between the adjacent blades 170*a* of the toner agitator 170 falls in the interior of the hopper 105 via the supply opening 104*a*, with the result that the toner is supplied to the developing device 104. In other words, the supply opening 104*a* is substantially opened. In this state, the agitating bar 102 rotates in the direction indicated by the arrow 102*a*, and the toner 120 is supplied from the toner container 101 to the hopper 105 through the supply opening 104*a*. The supplied toner 121 is stored in the hopper 105.

Based on the toner amount detection sensor 190, when the amount of the toner 121 is greater than or equals to the predetermined amount, the controller stops driving the solenoid 118, so that the force F shown in FIG. 18A disappears. As a result, the coupling gear 172 moves in the direction indicated by an arrow 172*e* (FIG. 18A) by the force of the spring 174, and separates from the receiving member 173 as shown in FIG. 18B. Thus, the engagement between the coupling gear 172 and the receiving member 173 is released, and therefore the shaft 175 stops rotating, so that the toner agitator 170 stops rotating. In this state, the supply opening 104*a* is substantially closed.

In the above operation, the toner 121 in the hopper 105 tends to be accumulated in the shape of a heap 121*a* whose peak positions directly below the supply opening 104*a*. In this state, the crank bar 181 is rotated (by the rotation of the supply roller 108) in the direction indicated by an arrow 181*a* in FIG. 19, and rapidly levels the heap 121*a* of the toner 121. As a result, the toner 121 is uniformly distributed in the hopper 105 in the longitudinal direction of hopper 105. Thus, it is possible to prevent the partial shortage of the toner 121 in the hopper 105, and to thereby prevent the defective printing. With such an operation, the amount of the toner 121 in the hopper 105 can be maintained within a suitable range. The printing operation of the fifth embodiment is the same as that of the first embodiment, and therefore duplicate explanation is omitted.

As described above, according to the fifth embodiment, when the amount of the toner 121 in the hopper 105 is less than the predetermined amount, the toner agitator 170 rotates to supply the toner to the developing device 104. When the amount of the toner 121 in the hopper 105 is greater than or equals to the predetermined amount, the toner agitator 170 closes the supply opening 104*a* to stop the supply of the toner. Thus, it is ensured that a sufficient space 105*a* is formed in the hopper 105 as shown in FIG. 15, and therefore the increase of the density of the toner 121 in the hopper 105 is prevented. Accordingly, the pressure increase of the toner 121 in the hopper 105 is prevented. As a result, the formation of the thin toner layer on the developing roller 109 and the charging of the toner by the developing blade 117 are suitably performed, with the result that the printing quality is enhanced.

Moreover, according to the fifth embodiment, the amount of the supply of the toner can be adjusted by adjusting the rotational speed of the toner agitator 170. For example, it becomes possible to supply a sufficient amount of toner to the developing device 104 in a relatively short (limited) time or in a relatively long time.

Furthermore, the crank bar 181 rapidly levels the heap 121*a* of the toner 121 in the hopper 105, and therefore the toner 121 is uniformly distributed in the longitudinal direction of the developing device 104, and the unbalance accumulation is corrected. Thus, it is possible to prevent the partial shortage of the toner 121 in the hopper 105, and to thereby prevent the defective printing.

In the fifth embodiment, it is possible to slide the coupling gear 172 by means of a driving source of the image forming apparatus, without providing the solenoid 119. Because a driving force for moving the coupling gear 172 is substantially the same as the force of the spring 174, it is possible to use an inexpensive driving source that generates a relatively weak driving force.

Alternative Arrangement

The crank bar (i.e., the second agitating member) 181 described in the fifth embodiment can also be applied to the developing device of any of the first through fourth embodiments.

Figure 20:
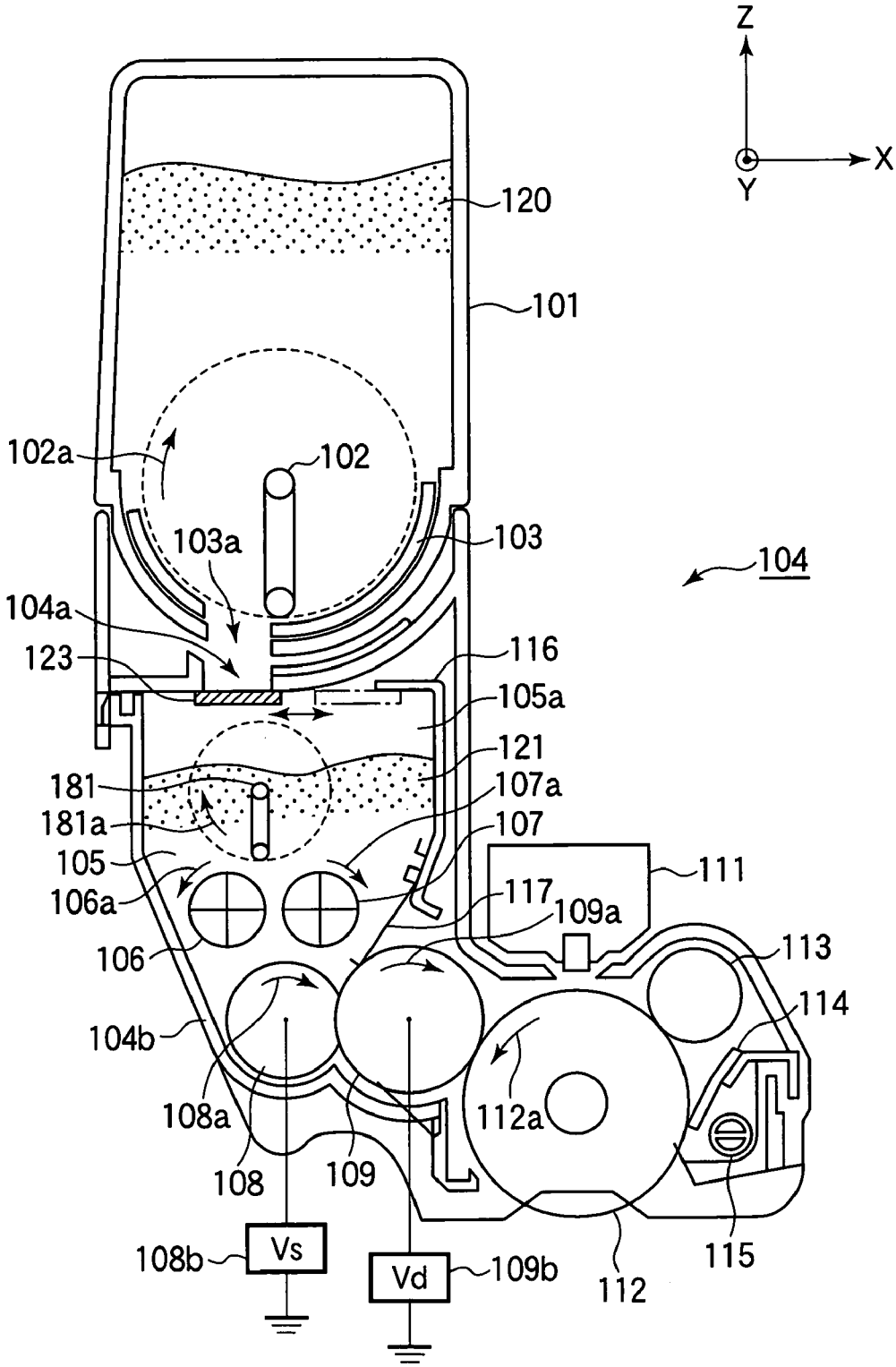
FIG. 20 is a sectional side view of an example of the developing device having a second agitating member described in the fifth embodiment.
Figure 21:
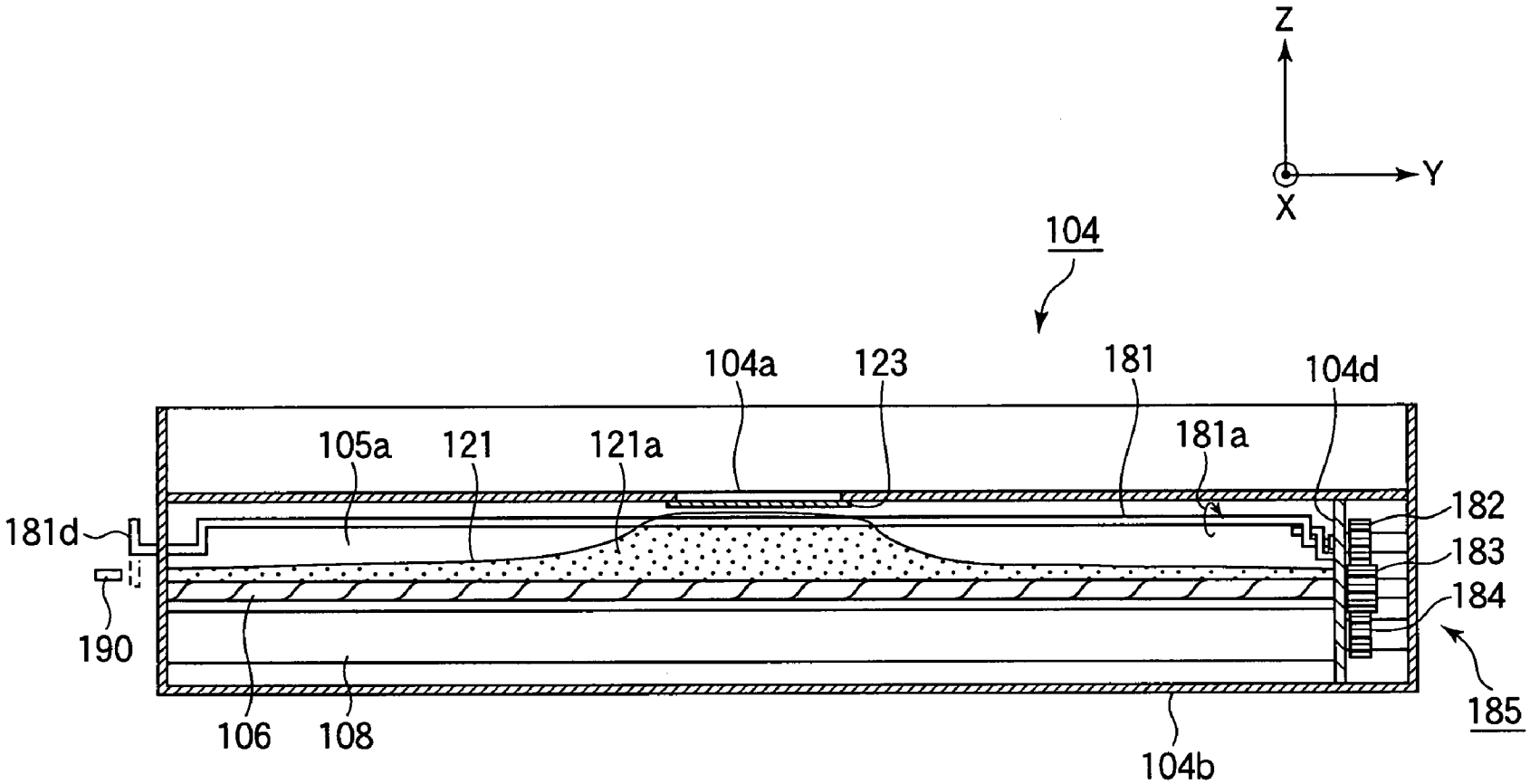
FIG. 21 is a sectional rear view of a main part of the developing device shown in FIG. 20.

FIGS. 20 and 21 are a side view and a rear view showing an example in which the crank bar 181 is applied to the developing device according to the first embodiment. As shown in FIGS. 20 and 21, the slidable shutter 123 (described in the first embodiment) is provided below the supply opening 104*a* to open and close the supply opening 104*a*. The other components are the same as those of the first embodiment.

As shown in FIG. 21, when the toner is supplied to the hopper 105, the toner 121 is accumulated in the shape of the heap 121*a* whose peak positions directly below the supply opening 104*a*. If the shutter 140 of the third embodiment is employed, the inclination of the heap 121*a* may relatively be gentle, but the heap 121*a* is still formed by the toner 121. In this state, the crank bar 181 rotates in the direction indicated by the arrow 181*a*, and rapidly levels the heap 121*a* of the toner 121, and therefore the toner 121 is uniformly distributed in the hopper 105. Therefore, it is possible to prevent the partial shortage of the toner 121 in the hopper 105, and to thereby prevent the defective printing.

In the structure shown in FIGS. 20 and 21, the driving force is transmitted to the crank bar 181 from the supply roller 108 by the transmission mechanism 185. In addition, in the above described fourth and fifth embodiments, the driving force is transmitted to the shutter 150 (or the toner agitator 170) from the supply roller 108. Therefore, if the crank bar 181 is employed in the fourth or fifth embodiment, it is necessary to provide two transmission mechanisms (i.e., tow gear trains) for transmitting the driving force. In this case, the transmission mechanisms can be provided on both sides of the hopper 105.

The developing device described in the first through fifth embodiments can be used in an image forming apparatus such as a printer, a copier, a facsimile.

Although the present invention is applicable to the developing device of a reversal development type mainly used in an electrophotographic image forming apparatus, the present invention is also applicable to the developing device of a direct development type without departing the scope of the invention.

While the preferred embodiments of the present invention have been illustrated in detail, it should be apparent that modifications and improvements may be made to the invention without departing from the spirit and scope of the invention as described in the following claims.

What is claimed is:

1. A developing device to which a developer container is detachably attached, said developer container having an outlet opening through which a developer is supplied and an opening-and-closing body that opens and closes said outlet opening, said developing device comprising:

a storing portion in which said developer is stored;

an agitating member provided in said storing portion for agitating said developer stored in said storing portion;

a supply opening through which said developer is supplied from said developer container to said storing portion, said supply opening being provided on an upper part of said storing portion and being located at substantially a center of said storing portion in a longitudinal direction of said storing portion; and an adjusting mechanism for adjusting the supply of said developer to said storing portion through said supply opening, said adjusting mechanism opening said supply opening when an amount of said developer in said storing portion is less than a predetermined amount, said adjusting mechanism closing said supply opening when the amount of said developer in said storing portion is greater than or equal to the predetermined amount, to stop the supply of said developer to said storing portion, so that a predetermined space is formed in said storing portion.

2. The developing device according to claim 1, wherein said adjusting mechanism comprises:

a detection unit that detects the amount of said developer in said storing portion; and a shutter mechanism that opens said supply opening when the amount of said developer is less than a predetermined amount, and closes said supply opening when the amount of said developer is greater than or equals to said predetermined amount.

3. The developing device according to claim 2, wherein said shutter mechanism comprises a shutter movable in a substantially horizontal plane below said supply opening.

4. The developing device according to claim 3, wherein said shutter is rotatable in said plane, and said shutter mechanism further includes a linear actuator and a converting member that converts a movement of said linear actuator into a movement of said shutter.

5. The developing device according to claim 3, wherein said shutter is elongated in one direction, and said shutter has a recessed groove elongated in a longitudinal direction of said shutter to increase the rigidity of said shutter against deformation.

6. The developing device according to claim 3, wherein said supply opening comprises a plurality of first openings, and said shutter has a plurality of second openings corresponding to said first openings, and wherein said second openings are aligned with said first openings when said shutter is in a first position, and said second openings are not aligned with said first openings when said shutter is in a second position.

7. The developing device according to claim 2, wherein said shutter mechanism comprises a rotatable shutter having a substantially horizontal rotation axis below said supply opening.

8. The developing device according to claim 7, wherein said shutter mechanism comprises:

first and second gears coaxial with each other and rotatable about said rotation axis;

an idle gear that engages said second gear; and a movable gear that selectively engages one of said first gear and said idle gear, wherein said shutter rotates in a predetermined direction when said movable gear engages said first gear, and rotates in an opposite direction when said movable gear engages said idle gear.

9. The developing device according to claim 2, wherein said adjusting mechanism comprises:

a detection unit that detects the amount of said developer in said storing portion; and an agitating mechanism having a first agitating member provided in said supply opening, wherein said agitating mechanism operates said first agitating member when the amount of said developer is less than a predetermined amount, and stops said first agitating member when the amount of said developer is greater than or equals to said predetermined amount.

10. The developing device according to claim 9, wherein said first agitating member comprises a plurality of blades rotatably provided in said supply opening, and said agitating mechanism further comprises a transmission mechanism that transmits a driving force of a component in said developing device to said plurality of blades.

11. The developing device according to claim 1, further comprising a second agitating member provided in said storing portion below said supply opening, wherein said second agitating member agitates said developer supplied from said developer container through said supply opening so that said developer is dispersed in a longitudinal direction of said developing device.

12. An image forming apparatus comprising said developing device according to claim 1.

13. A developing device to which a developer container is detachably attached, said developing device comprising:

a storing portion in which a developer is stored;

a supply opening through which said developer is supplied from said developer container to said storing portion, said supply opening being provided on an upper part of said storing portion and being located at substantially a center of said storing portion in a longitudinal direction of said storing portion; and an adjusting mechanism for adjusting the supply of said developer to said storing portion through said supply opening, wherein said adjusting mechanism includes:

a detection unit that detects an amount of said developer in said storing portion; and a shutter mechanism that opens said supply opening when said amount of said developer is less than a predetermined amount, and closes said supply opening when said amount of said developer is greater than or equals to said predetermined amount.

14. The developing device according to claim 1, wherein said adjusting mechanism includes an opening-and-closing member movable in a widthwise direction of said agitating member.

15. The developing device according to claim 1, further comprising a developer image bearing member disposed in said storing portion, wherein said agitating member is disposed above said developer image bearing member, and said supply opening is disposed above said agitating member.

16. The developing device according to claim 1, wherein said agitating member carries said developer in the direction from the center of said storing portion toward either end of said storing portion, and carries said developer in the direction from either end of said storing portion toward the center of said storing portion.

* * * * *